US006808027B2

(12) United States Patent
McLoughlin et al.

(10) Patent No.: US 6,808,027 B2
(45) Date of Patent: Oct. 26, 2004

(54) WELLBORE DIRECTIONAL STEERING TOOL

(75) Inventors: Stephen John McLoughlin, Nr. Selby (GB); Jeffrey B. Lasater, Houston, TX (US); Jack P. Chance, Houston, TX (US); George B. Sutherland, The Woodlands, TX (US); Feroze M. Variava, Eastwood (GB); Emerson Marcellus, Houston, TX (US)

(73) Assignee: RST (BVI), Inc. (VG)

( * ) Notice: Subject to any disclaimer, the term of this patent is extended or adjusted under 35 U.S.C. 154(b) by 0 days.

(21) Appl. No.: 09/878,715

(22) Filed: Jun. 11, 2001

(65) Prior Publication Data

US 2002/0185315 A1 Dec. 12, 2002

(51) Int. Cl.[7] ..... E21B 7/08
(52) U.S. Cl. ..... 175/24; 175/45; 175/73
(58) Field of Search ..... 175/45, 26, 73, 175/76, 61, 24

(56) References Cited

U.S. PATENT DOCUMENTS

| | | | | |
|---|---|---|---|---|
| 3,561,549 A | | 2/1971 | Garirison | |
| 3,626,482 A | * | 12/1971 | Quichaud et al. | 340/853.6 |
| 4,220,213 A | | 9/1980 | Hamilton | 175/45 |
| 4,394,881 A | | 7/1983 | Shirley | |
| 4,638,873 A | | 1/1987 | Welborn | |
| 4,697,650 A | * | 10/1987 | Fontenot | 175/50 |
| 5,220,963 A | | 6/1993 | Patton | 175/24 |
| 5,358,059 A | * | 10/1994 | Ho | 175/45 |
| 5,439,064 A | * | 8/1995 | Patton | 175/24 |
| 5,484,029 A | | 1/1996 | Eddison | |
| 5,979,570 A | | 11/1999 | McLoughlin et al. | |

FOREIGN PATENT DOCUMENTS

| | | | |
|---|---|---|---|
| EP | 0674093 A2 | 3/1995 | E21B/7/06 |
| GB | 2356207 A | 11/1999 | E21B/47/12 |
| WO | WO 96/31679 | 10/1996 | E21B/7/06 |
| WO | WO97/47848 | 12/1997 | E21B/7/06 |
| WO | WO00/65198 | 11/2000 | E21B/47/12 |

OTHER PUBLICATIONS

International Search Report PCT/GB02/02784.

* cited by examiner

*Primary Examiner*—David Bagnell
*Assistant Examiner*—Giovanna Collins
(74) *Attorney, Agent, or Firm*—C. W. Alworth

(57) ABSTRACT

An apparatus for selectively controlling the direction of a well bore comprising a mandrel rotatable about a rotation axis; a direction controller means comprising at least two parts configured to apply a force to said mandrel with a component perpendicular to the said rotation axis; a housing having an eccentric longitudinal bore forming a weighted side and being configured to freely rotate under gravity; and a driver for selectively varying the angle of the force relative to the weighted side of the housing about said rotation axis, the driver being configured to move the two parts independently of one another.

12 Claims, 15 Drawing Sheets

WELLBORE DIRECTIONAL STEERING TOOL

FIELD OF INVENTION

The present invention relates to the field of oil and gas drilling. More specifically the present invention relates to an apparatus and method for selecting or controlling, from the surface, the direction in which a wellbore proceeds.

A drill operator often wishes to deviate a wellbore or control its direction to a given point within a producing formation. This operation is known as directional drilling. One example of this is for a water injection well in an oil field which is generally positioned at the edges of the field and at a low point in that field (or formation).

In addition to controlling the required drilling direction, the formation through which a wellbore is drilled exerts a variable force on the drill string at all times. This along with the particular configuration of the drill can cause the drill bit to wander up, down, right or left. The industrial term given to this effect is "bit-walk" and many methods to control or re-direct "bit-walk" have been tried in the industry. The effect of bit walk in a vertical hole can be controlled, by varying the torque and weight on the bit while drilling a vertical hole. However, in a highly inclined or horizontal well, bit-walk becomes a major problem.

BACKGROUND OF THE INVENTION

At present, in order to deviate a bole left or right, the driller can choose from a series of special downhole tools such as downhole motors, so-called "bent subs" and more recently a steerable motors.

A bent sub is a short tubular that has a slight bend to one side, is attached to the drill string, followed by a survey instrument, of which an MWD tool (Measurement While Drilling which passes wellbore directional information to the surface) is one generic type, followed by a downhole motor attached to the drill bit. The drill is lowered into the wellbore and rotated until the MWD tool indicates that the leading edge of the drill bit is facing in the desired direction. Weight is applied to the bit through drill collars and, by pumping drilling fluid through the drill string, the downhole motor rotates the bit.

U.S. Pat. No. 3,561,549 relates to a device which gives sufficient control to deviate and start an inclined hole from or control bit-walk in a vertical wellbore. The drilling tool has a non-rotating sleeve with a plurality of fins (or wedges) on one side is placed immediately below a downhole motor in turn attached to a bit.

U.S. Pat. No. 4,220,213 relates to a device which comprises a weighted mandrel. The tool is designed to take advantage of gravity because the heavy side of the mandrel will seek the low-side of the hole. The low side of the wellbore being the side furthest away from the vertical.

U.S. Pat. No. 4,638,873 relates to a tool which has a spring-loaded shoe and a weighted heavy side which can accommodate a gauge insert held in place by a retaining bolt.

U.S. Pat. No. 5,220,963 discloses an apparatus having an inner rotating mandrel housed in three non-rotating elements.

Thus, it is known how to correct a bit-walk in a wellbore. However, if changes in the forces that cause occur while drilling, all the prior art tools must be withdrawn in order to correct the direction of the wellbore. The absolute requirement for tool withdrawal means that a round trip must be performed. This results in a compromise of safety and a large expenditure of time and money.

The applicant's own previous patent application WO 96/31679 and U.S. Pat. No. 5,979,570 partially addresses the problem of bit-walk in an inclined wellbore. The device described in this patent application and patent comprises eccentrically bored inner and outer sleeves. The outer sleeve being freely moveable so that it can seek the low side of the wellbore, the weighted side of the inner eccentric sleeve being capable of being positioned either on the right side or the left side of the weighted portion of the outer eccentric sleeve to correct in a binary manner for bit walk.

The applicant has now developed an improved downhole tool which can correct for bit walk in a highly inclined wellbore and which is capable of controlling both the inclination and the Azimuthal plane of the well bore.

SUMMARY OF THE INVENTION

In a first aspect, the present invention provides an apparatus for selectively controlling the direction of a well bore, the apparatus comprising:

a mandrel rotatable about a rotation axis; a direction controller means comprising at last two members spaced apart along said mandrel and configured to apply a force to said mandrel with a component perpendicular to the said rotation axis;

a housing having an eccentric longitudinal bore forming a weighted side and being configured to freely rotate under gravity; and a driver for selectively varying the angle of the force relative to the weighted side of the housing about said rotation axis, the driver being capable of moving the two parts independently of one another.

The provision of a two part direction controller allows more control over the drilling direction in order to drill in a required direction and to compensate for bit-walk. Further, the provision of a two part direction controller allows a null or a zero force to be applied to the mandrel by precessing the direction controller about the mandrel.

The two parts of the direction controller can be configured in a number of different ways. Preferably, the two parts are located on different sides of the central plane. A particularly preferable arrangement is achieved when both of the two parts are capable of applying a independent force to the mandrel. For example, the two parts may be located on either side of the central plane of the housing. For example, both parts may comprise eccentric sleeves.

In an alternative configuration, only one part is capable of applying a radial force to the mandrel, the other part only being capable of applying a symmetric force about the mandrel. For example, one part may be an eccentric sleeve and the other may be a concentric sleeve. If the arrangement is envisaged where a concentric sleeve is located on one side of the central plane and an eccentric sleeve is located on the other, then it is possible to form a so-called "point the bit" arrangement. The eccentric sleeve may be located either above or below the central plane of the housing. Two eccentric sleeves oriented at 180° to each other about the mandrel can also achieve this effect.

References have been made to the at least one part being eccentrically bored. However, it should be noted that the same effect can be achieved with a sleeve which is spatially symmetric about the rotation axis, but which has a denser material or a weight located at one side of the sleeve.

Further there is no requirement for the direction controller to be a sleeve. A cam or even a linear actuator could be used to the same effect as an eccentric sleeve.

The driver is configured to move the two parts of the direction control means independent of one another. This is applicable regardless of the nature of the direction controller for example if the direction control means comprises a sleeve, cam, linear actuator or another component which can achieve the same result.

Where the direction controller comprises a linear actuator, the actuator may be mounted such that that can move about the circumference of said mandrel to apply a force to the mandrel at the required position. Preferably, a plurality of linear actuators are placed around the circumference of the mandrel. More preferably, at least three actuators are used at equal angles in a plane about said mandrel. The three actuators being capable of applying a force to the mandrel in any direction in a plane about its axis. Therefore, in a second aspect, the present invention provides an apparatus for selectively controlling the direction of a wellbore, the apparatus comprising: a mandrel which is rotatable about a rotation axis;

a direction controller comprising at least one linear actuator configured to apply a force to said mandrel;

a housing having an eccentric longitudinal bore and being configured to freely rotate under gravity; and a drive means for selectively varying the angle of the force relative to the weighted side of the housing about said rotation axis.

Preferably, the driver in accordance with either the first or the second aspects of the present invention is configured to change the direction of the force within a tolerance of at most 10°, more preferably at most 5°, even more preferably at most 1°.

A possible configuration of the driver and the direction controller can be achieved by drive wheel and track arrangement.

The track and drive wheel preferably comprise a plurality of interengaging teeth to effect movement therebetween. Such an arrangement is commonly referred to as a pinion and drive wheel arrangement. This arrangement is particularly preferable as, when stationary, the drive wheel locks against the track serving to secure the inner sleeve in position relative to the housing. The track and drive wheel arrangement could also be provided by a drive wheel with a circumference which has a high coefficient of friction with the said track.

The said drive wheel may be located on a part of the direction controller and the housing may be provided with a track on its internal surface, such that movement of the drive wheel causes movement of the said part of the direction controller with respect to the housing. Alternatively, the drive wheel may be located in the outer housing and a part of the direction controller may be provided with a track such that movement of the drive wheel affects relative movement between the said part of the direction controller and the housing. This arrangement is preferable as it allows a power source to drive the drive wheel to be located within the housing.

The above drive means have been described with relation to the movement of a single part of the direction controller. However, a single drive wheel could be used to move the two parts of the direction control means. Two such drive means may be used to drive the two parts of the direction controller respectively.

The driver may comprise a hydraulic or electric motor or the like. Further, drive means may be battery powered or powered by the rotation of the rotating mandrel.

In operation, the driver is required to move the direction of the force with respect to the outer housing. Typically, some means are required to instruct the driver to move the position of the direction of application of the force on the mandrel.

Therefore, the apparatus preferably further comprises logic means for determining when the direction of the force applied by the direction controller should be moved. The logic means may be located in the downhole assembly, or they may be located at the surface with means for communicating with the downhole assembly. If the logic means are located within the downhole assembly they may be configured to send and/or receive information from the surface in order to determine when the direction of the force should be moved.

If the logic means are located at the downhole assembly and are configured to receive information from the surface, preferably information is sent to the logic means using one of the parameters which are readily available during drilling. For example, the weight on the drill bit and pump cycling.

The logic means may comprise a sensor for sensing a wellbore fluid pulses and decoding said pulses to determine when the direction of the force should be changed. A series of fluid pulses can be sent down said drill string. The drill string pulses can be used to encode data to send to the downhole assembly.

The fluid pressure could also be used to determine the position of the force of the direction controller. For example, fluid passageways could be provided which extend generally radially through said mandrel, said direction controller and said housing such that, when said direction controller, which may for example, be a sleeve, cam etc., is in a first position, said series of drilling fluid passageways align with each other so as to allow drilling fluid to flow readily from said interior of the said mandrel to said exterior of said housing accompanied by a relatively low pressure drop, and when said sleeve is not in the fist position, said drilling fluid passageways are in misalignment so as to restrict drilling fluid flow from said interior of said mandrel to said exterior of said housing accompanied by relatively high pressure drop. This allows the position of the direction control means to be determined.

In a preferred arrangement, the above is achieved by the provision of a bit-jet and orifice combination positioned within said generally radial passageway in said mandrel adjacent said direction control means.

Further, the logic means may comprise a detector for detecting the rotating of the drill string. The drill string rotation could be detected by using magnetic fields for example in the manner described in GB 2 356 207. The logic means may be configured to detect the frequency rotation of the drill string. This allows a magnitude of a scalar parameter such as an angle through which to move the force applied by the direction control means. The logic means may be configured to determine a time period between rotation and non-rotation of the drill string wherein said time period determines when the angle of said force should be changed with respect to the weighted side of said housing or the radial position of the housing.

The logic means and the driver may be stored within the housing. Alternatively, the logic means may be located within a tubular housing connected to at least one of the mandrels, direction controller and housing. The apparatus may further comprise an energy source for supplying power to the driver and/or logic means.

Preferably, the rotating mandrel is terminated at both ends in the appropriate standard tool joint used in the drilling industry for ready attachment to subs, the bit, other downhole tools, or drill pipe.

The rotating mandrel is used to transfer the rotary motion of the drill pipe to the drill bit and acts as continuation conduit of the drill pipe for all drilling fluids passing down the drill pipe and onto the drill bit.

The above description has primarily considered sending information from the surface to the downhole assembly in order to change the position of the force on the mandrel. However, during drilling, the downhole assembly is actually located within the wellbore, therefore the downhole assembly itself is a far better position to determine data concerning the strata then any surface based analysis equipment.

Therefore, preferably, the downhole assembly is provided with a sensor for sensing geological information about the formation being drilled.

Therefore, in a third aspect, the present invention provides an apparatus for selectively controlling the direction of a well bore comprising a mandrel rotatable about a rotation axis; a direction control means comprising configured to apply a force to said mandrel with a component perpendicular to the said rotation axis; a housing having an eccentric longitudinal bore forming a weighted side and being configured to freely rotate under gravity; a drive means for selectively varying the angle of the direction of force about said rotation axis; and sensing means for sensing information about the formation which is being drilled.

The sensing means preferably comprises a sensor and analysing means for analysing data collected by the sensor. If the analysis is performed by the downhole assembly, then there is no time wasted in sending the data to the surface. Another stage further would be to allow the tool to control itself on the basis of the data sensed by its sensors.

In a fourth aspect, the present invention provides an apparatus for drilling a well bore, the apparatus comprising a drilling member configured to drill in a predetermined drilling direction; direction control means for controlling the drilling direction of said drilling member; a sensor for determining at least a characteristic of the strata being drilled; wherein said direction control means determines the drilling direction based on the data collected by said sensor.

Preferably, the sensor is configured to detect gamma rays.

The apparatus may further comprise a plurality of stabiliser shoes. These stabiliser shoes may be circumferentially offset by a predetermined amount in relation to the weight of the housing. More preferably, the apparatus comprises two stabiliser shoes. The stabiliser shoes which may be blades, wedges etc. extend radially outward and laterally along the circumference on either side of the outer eccentric sleeve or outer housing.

BRIEF DESCRIPTION OF THE DRAWINGS

The present invention will now be described with reference to the following preferred non-liming embodiments in which:

FIG. 17 are conceptual drawings showing how the upper and lower inner sleeve portion interact with the inner sleeve to arrive at bit point. FIG. 17A shows the instant device with two eccentric sleeves; whereas, FIG. 18 are simplified diagrams distinguishing between bit offset and bit point.

DETAILED DESCRIPTION OF THE INVENTION

Figure 1:
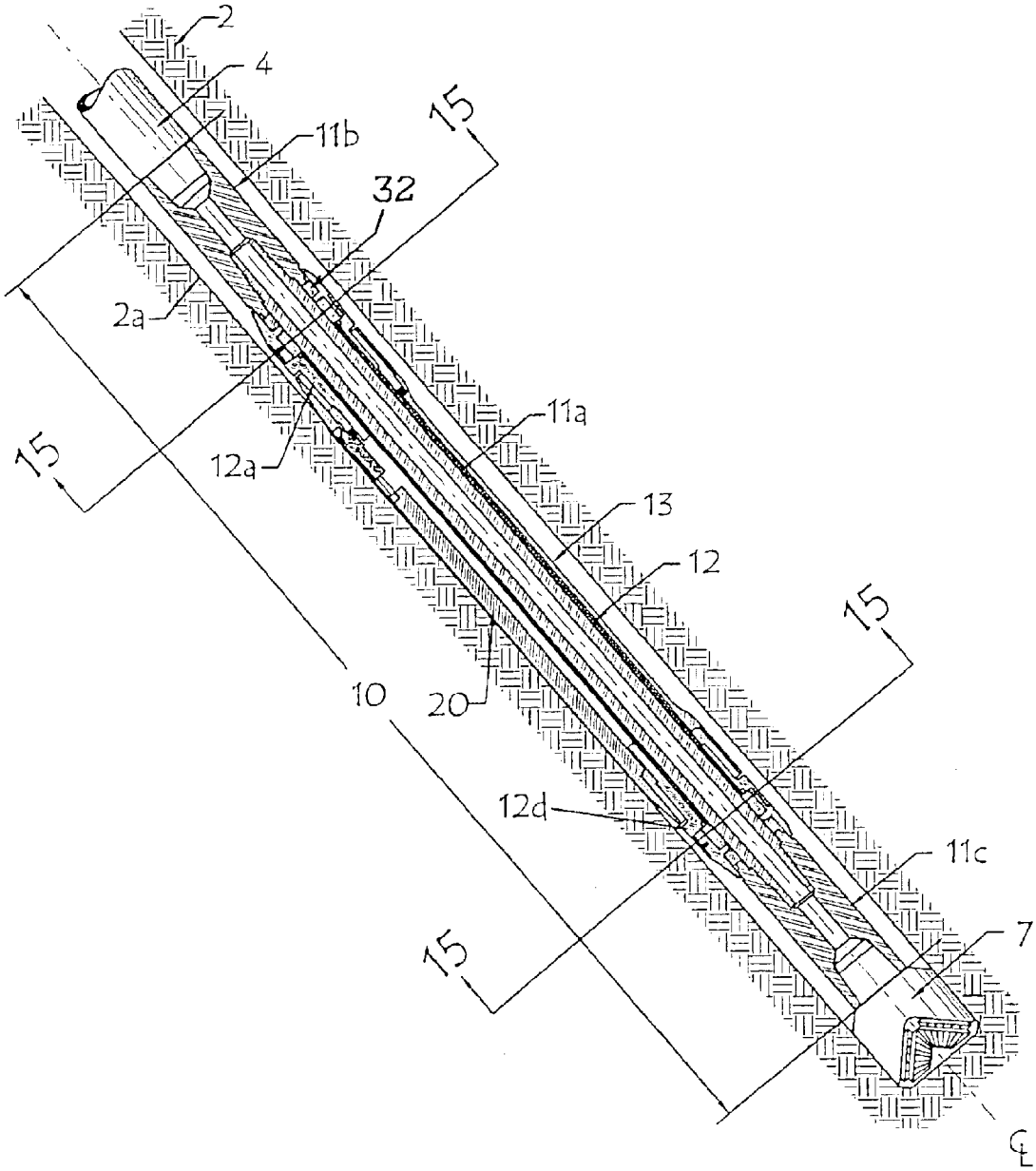
FIG.1 shows an elementary cutaway side elevational view of an apparatus according to an embodiment of the invention utilizing eccentric sleeves in a slightly inclined wellbore having its low-side on the left.

Before the device is described, the phenomena of "bit walk" will be discussed in more detail.

The formation through which a wellbore is drilled exerts a variable force on the drill string at all times. This variable force is essentially due to the clockwise rotary motion of the bit, the weight applied to the drill bit and the strata of the formation. Formation is a general term used to define the material—namely rock, sand, shale, clay, etc.—that the wellbore will pass through in order to open a pathway or conduit to a producing formation. This variable force will result in a variable change in the direction of the wellbore.

The formation is generally layered by the action of nature over millions of years and is not necessarily level. The formation will have dips, defined as a change in direction of the layers of the formation, which can extend either upward or downward. As the drill bit moves into a dip or from one type of formation to another, the force on the drill bit will change and cause the drill bit to wander up, down, right or left. This wandering is the natural result of the reaction of the formation to the clockwise torque and forward drilling force exerted by the drill bit on the formation. Mathematically the result can be viewed as a simple vector cross product between the torque force and the drilling force or weight on bit. The cross product results in a component force towards the right of the drilling force. The industrial term given to this effect is "bit-walk" and many methods to control or redirect "bit-walk" have been tried in the industry.

Bit-walk is predictable, but the magnitude and, frequently, the direction of bit-walk are generally unpredictable. Looking at the vector cross product model, it can be seen that as the drilling force or weight on bit is varied, the cross product varies. Or, as the RPM of the drill string is varied, the cross product varies. Or, as the formation changes, the cross product changes. In drilling a wellbore, all of these for constantly vary; thus, the magnitude of bit-walk constantly changes. The industry has learnt to control the effects of bit-walk in a vertical hole by varying the torque and weight on bit while drilling a vertical hole. However, in an inclined (non-vertical) hole bit-walk is more problematic.

By industry definition, once an inclined hole is established, the side of the wellbore nearest to true horizontal is called the "low-side" of the hole. The opposite side of the hole is referred to as "high-side" and is used as a reference point throughout the wellbore drilling operation. The drilling force follows the longitudinal extension of the wellbore; thus, the drilling force is parallel to and spaced from the low-side of the hole. Since bit-walk is the result of applied torque and drilling force, then it can be anticipated that normal bit-walk will be to the right of the low-side of the hole. This definition applies in all wellbores.

In a vertical hole or slightly inclined hole, bit-walk may be controlled by developing as much rigidity as possible in the lower portion of the drill string near to the drill bit. This can be and generally is accomplished by using drill string components of high rigidity and weight (drill collars or heavy-weight drill pipe) and stabilizers. A stabilizer, well known in the industry, is a tubular member with a combination of radial blades or wedges (generally referred to as stabilizer shoes or blades), often having a helical configuration, circumferentially arranged around the tubular and extending beyond the outer diameter of the tubular. The extension of the stabilizer blades is limited to the diameter of the drill bit. Thus, the stabilizer will work in a stable hole. However, if the wellbore washes out (increases in diameter due to formation or other downhole mechanical or hydraulic effects) or where the lateral force exerted by the blades is less than the torque effect of the drill bit, then the stabilizer loses its effectiveness and bit-walk will occur. Thus, in a highly inclined or horizontal well, bit-walk becomes a major problem.

Very often the driller wishes to deviate the wellbore or control its direction to a given point within a producing formation. This operation is known as directional drilling. For example, a water injection well in an oil field is generally positioned at the edges of the field and at a low point in that field (or formation). A vertical wellbore will be established and the wellbore "kicked-off" from vertical so that an inclined (or even horizontal) wellbore results. It is now necessary to selectively guide the drill bit and string to the required point in the relevant formation. In order to achieve this objective,control of the wellbore is required in both the vertical plane (i.e. up and down) and in the horizontal plane (i.e., left and right).

FIG. 1 is a side elevational shows a cutaway view of a downhole device, 10. The device is shown in an inclined wellbore. FIG. 1 amplifies the low-side 2*a* of the hole 2, which the industry defines as the side of the hole nearest the center of the earth. The low-side of the hole, 2*a*, is on the left-hand side of the overall wellbore, 2.

The device 10 is shown attached to an upper adapter sub, 4, which would in turn be attached to a drill string (not shown). The adapter sub is located at the upper end of the device 10, i.e. the end of the device 10 which is closest to the opening of wellbore 2. The adapter sub is attached to an inner rotatable mandrel, 11. For the purposes of this description, the relative terms upper and lower are defined with to the wellbore, the upper end of the wellbore being the open end, the lower end being the drilling face.

The adapter sub serves to connect the drill string to the inner rotatable mandrel 11. However, the adapter sub 4 may not be necessary if the drill string pipe threads match the device 10 threads.

The mandrel 11 has an elongate central part 11*a* which extends almost the whole length of the tool 10. At either end, the central part of the mandrel 11*a* is connected to an upper mandrel section 11*b* and a lower mandrel section 11*c*.

The upper part 11*b* of the mandrel 11 is attached to upper adapter sub 4.

The lower part 11*c* of the inner rotating mandrel, 11, is attached directly to a drill bit, 7. In practice a lower adapter sub may be located between the mandrel and drill bit 7 if the threads differ between the mandrel 11 and drill bit 7.

An inner eccentric sleeve 12 is located about at least a part of said mandrel. The mandrel 11 is free to rotate within the inner eccentric sleeve, 12. In practice, bearing surfaces will be present between the inner rotating mandrel, 11, and the inner eccentric sleeve, 12 to allow rotation of the mandrel 11. The mandrel, 11, must be capable of sustained rotation within the inner sleeve, 12. The bearing surfaces will be discussed in more detail later in the description.

The inner sleeve 12 of the example has two parts, an upper part 12*a* and a lower part 12*d*. In the device 10 of FIG. 1, both the upper part 12*a* and the lower part 12*d* have an eccentric bore for receiving the mandrel 11. The upper part 12*a* is located close to the top end of the device 10 and the lower part 12*d* is located towards the lower part of the device 10. The upper and lower parts of the inner sleeve are spaced apart from one another along the length of the mandrel 11.

An essentially tubular housing, which will be referred to as outer housing 13 completes the device 10 as shown in the Example of FIG. 1. In the example of FIG. 1, the outer housing 13 houses the middle part 11*a* of the mandrel 11. The upper 12*a* and lower 12*d* parts of the inner sleeve are located at the upper and lower ends of the housing 13 respectively, such that the housing 13 only covers a portion of each of the tipper and lower parts of the inner sleeve 12*a*, 12*d*.

The inner eccentric sleeve, 12, may be turned freely within an are, by a drive means (not shown), inside an outer eccentric housing or mandrel, 13. The bearing surfaces between the inner and outer mandrels are not critical as they are not in constant mutual rotation. However, they must be capable of remaining clean in the drilling environment. Sealed bearing Systems would be appropriate.

The outer housing is eccentric on its outside. This heavier side of the housing 13 is referred to as the "pregnant portion", 20.

The pregnant portion 20, of the outer housing forms the heavy side of the outer housing and is manufactured as a part of the outer housing. The outer housing 13 is freely rotatable under gravity such that the pregnant portion 20, will always seek the low side of the wellbore. In operation, the position of the inner sleeves is set with respect to the position of the pregnant portion 20 of the outer housing. Therefore, the inner sleeve 11 is moveable with respect to the outer housing.

Figure 2:
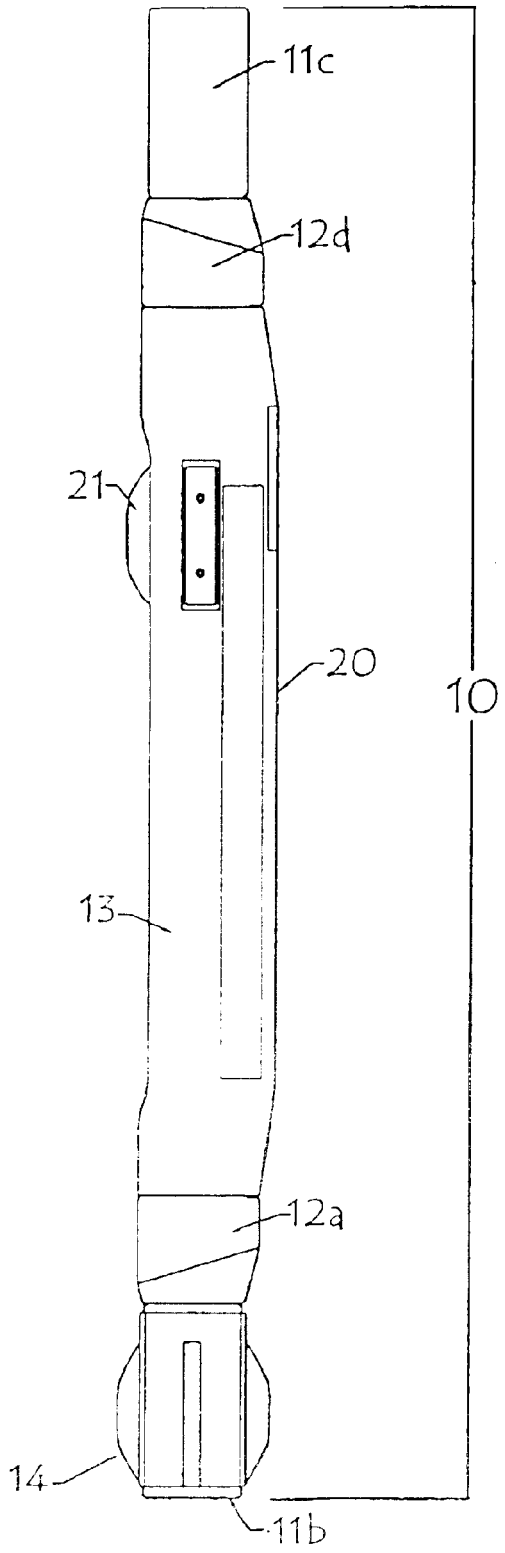
FIG. 2 is an elementary side elevational view of the tool of FIG. 1, having a weighted side on the right and illustrating the position of the stabilizer shoes.
Figure 3:
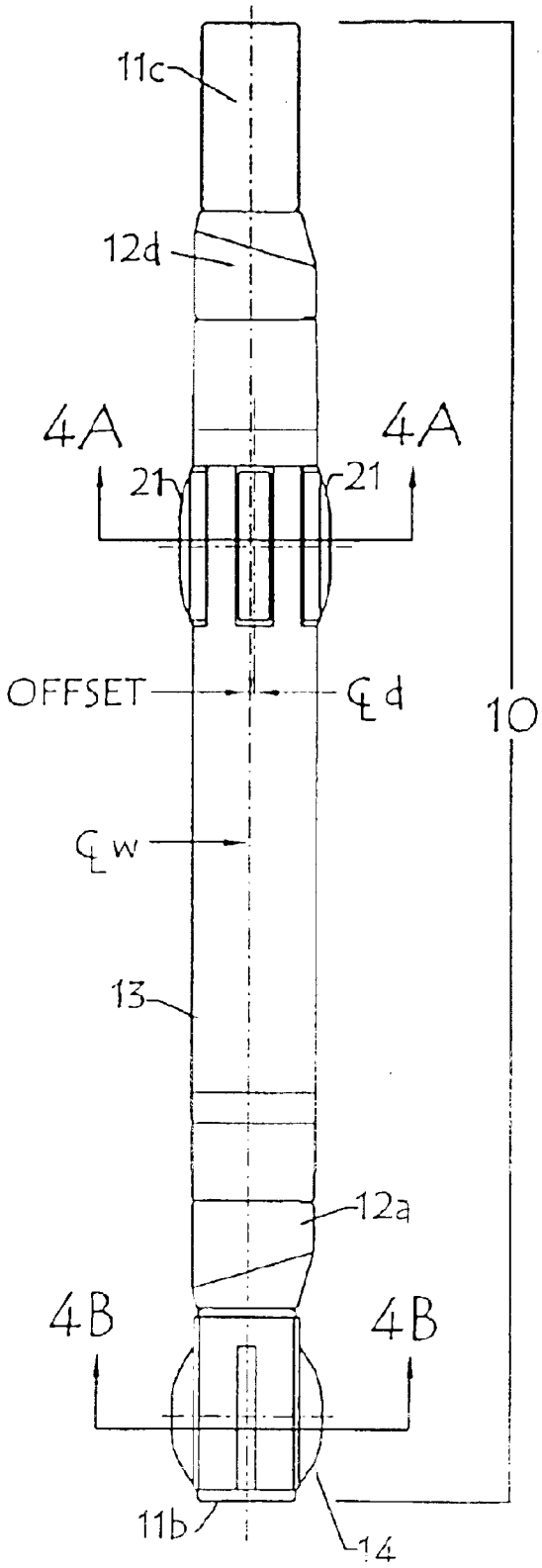
FIG. 3 is an elementary side elevational view of the tool of FIG. 1, rotated through ninety-degrees.

FIGS. 2 and 3 are external views of the device 10. The device is shown without upper adapter sub 4 or drill bit 7. The upper and lower parts 11*b* and 11*c* of the mandrel are respectively located at the top and bottom of the device 10. Adjacent the upper and lower parts 11*b* and 11*c* of the mandrel 11 are located the upper and lower parts 12*a* and 12*d* of the inner sleeve. Viewed from the outside, the outer housing 13 is located between the upper 12*a* and lower 12*d* parts of the inner sleeve. As explained with reference to FIG. 1, the upper and lower parts of the inner sleeve 12 are partially located within the housing 13. The position of the pregnant portion 20 of housing 13 is shown in outline.

Stabiliser shoes 21 are located on the outside of housing 13. In this particular example, three stabiliser shoes are located around the circumference of the housing 13. The shoes are elongate and are aligned parallel with the rotation axis of the device 10. The shoes 21 are positioned at 90° intervals from one another. As there are only three shoes, they do not extend around the whole circumference of the outer housing. The shoes 21 are arranged so that there is a first shoe 180° away from the weighted portion, with two shoes positioned on either side of the first shoe. The shoes 21 serve to counter any reactionary rotation on the part of the outer housing caused by bearing friction between the rotating mandrel, 11, and the inner sleeve, 12, and to center the housing 13, within the borehole 2.

The stabilizer shoes are normally removable and are sized to meet the wellbore diameter. In fact, the same techniques used to size a standard stabilizer would be applied in choosing the size of the stabilizer shoes. Alternatively, the shoes, 21, could be formed integrally with the outer housing, 13.

Other designs which incorporate anti-rotation features may also used. For example, at least a part of the outer surface of the housing may be provided with tooth like projections which are capable of engaging with the side of the well-bore. Clutch mechanisms may also be employed in order to stabilise the outer housing.

FIG. 3 shows the device of FIG. 2 rotated through 90°. Three secondary shoes 14 are located around the lower part 11*c* of mandrel 11. These stabiliser shoes 14 are arranged symmetrically around the circumference of the mandrel with 120° between each shoe 14.

FIGS. 2 and 3 show the principle axis of wellbore 2 as $C/L_W$ and the rotation axis of the bit (or drill string) as $C/L_D$. The rotation axis of the drill string and the principle axis of the wellbore will not always be parallel to one another. For example, when the direction control means effects a change in the desired drilling direction. The rotation axis and the principle axis are offset by the eccentricity of the inner sleeve in FIG. 3 and are co-located in the views of FIGS. 2 and 4.

When the tool is viewed through the axis which passes through the pregnant housing, the longitudinal axes are offset; on the other hand, when viewed through the axis which passes through the two stabilizer shoes, 21, the two longitudinal axes are co-located.

Previously, the requirement of bearing surfaces between the inner surface of the inner sleeve and the outer surface of the rotating mandrel was mentioned.

The bearings between the inner rotatable mandrel and the inner sleeve, 12, pose a number of interesting problems. If the tool is used in conventional drilling, the inner mandrel must be capable of turning at speeds of up to 250 RPM within the inner sleeve. If the tool is used with downhole motors, the bearing speed will depend on the position of the downhole motor with respect to the tool, but may be substantially higher than the 250 RPM used in normal drilling. The downhole motor may be placed at either end of the tool. If the motor is placed next to the bit, then the rotational bearing speed will be zero. If the tool is placed between the downhole motor and the bit, the rotational speed will be the same as that of the output shaft of the downhole motor. This speed can be higher than 250 RPM, which is normally regarded as the maximum RPM encountered in conventional rotary drilling.

The inner mandrel to inner sleeve high speed bearings must be lubricated, and the lubricating fluid will be the drilling fluid that circulates throughout the system. This means that the bearing must be capable of operating with some solids, having a potentially abrasive nature, present in the stream. Bearings of this nature are well understood in the industry and will cause little problem. The thrust bearing, between the two elements, see location 32 on FIG. 1, must be en to show wear and is designed so that it can be replaced at reasonable service intervals without recourse to sophisticated service facilities. Basically the thrust bearing surface is a sacrificial bearing and plans should be made to replace this bearing with each change of bit. (At least the bearing should be examined each time the tool comes to the surface.) Means can also be provided to measure the bearing wear at the surface without loss of time.

The rotation between the outer housing, 13, and the inner sleeve, 12, is controlled from the surface and is an 'on demand' occurrence. Thus, these bearing surfaces need not take high continuous rotation speeds and standard sealed bearings may be used.

Figure 4A:
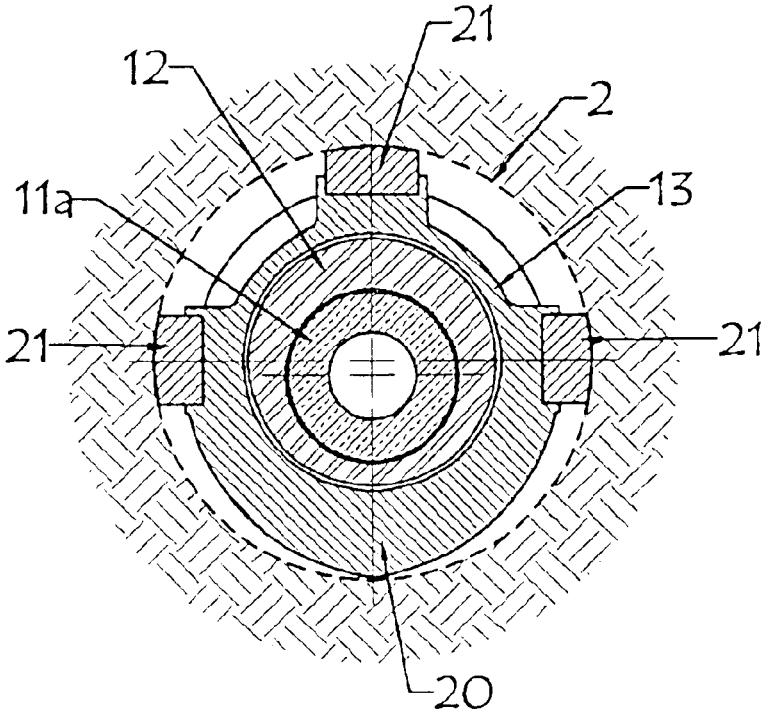
FIG. 4A is elementary cross section of the tool of FIGS. 2 and 3 taken at 4A-4A in FIGS. 2 and 3.

FIG. 4A shows a cross section of the tool 10 through line 4A-4A of FIG. 3. In FIG. 4A, the pregnant portion 20 of the outer housing 13 locates itself at the low side of the wellbore 2. The stabiliser shoes 21 located on the circumference of the outer housing are arranged such that the middle shoe is located against the high side of the wellbore 2 with the other two shoes located on the right and left sides of the wellbore 2. The inner sleeve 12 is located within the bore of the housing 13. Previously, the inner sleeve 12 has been described in terms of two parts, an upper 12*a* and a lower part 12*d*. FIG. 4 just shows the upper part 12*a* of the sleeve. However, it will be appreciated by those skilled in the art that the lower part 12*d* of the sleeve 12 could also be used in this cross section. The inner sleeve 12 is eccentrically bored. The mandrel 11, or more correctly, the central part of the mandrel 11*a* is located within the bore of the inner sleeve 12. The inner sleeve 12 can be rotated with respect to the pregnant part 20 of the outer housing 13 thus changing the force on the mandrel 11.

Figure 4B:
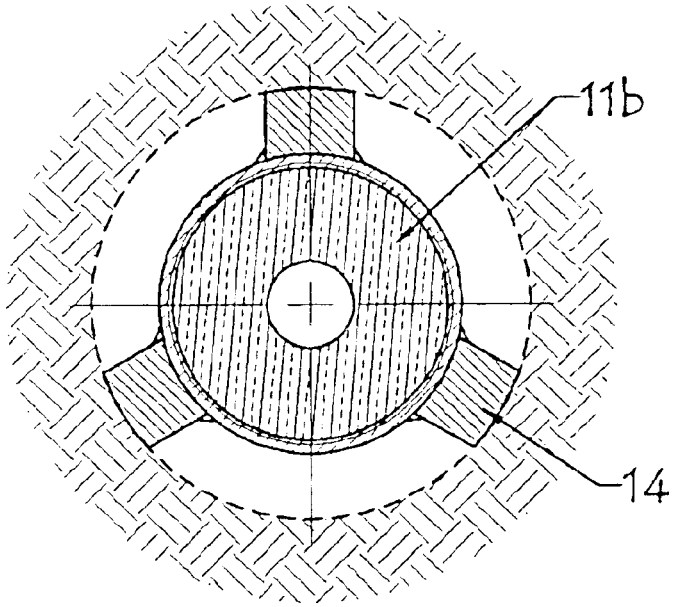
FIG. 4B is an elementary cross section of the tool of FIGS. 2 and 3 taken at 4B-4B in FIGS. 2 and 3.

FIG. 4B shows a cross section through line 4B-4B of FIG. 3. In this part of the tool, there is no outer housing 13 or inner sleeve 12. The figure just shows the mandrel 11, with its concentric bore. Three secondary stabiliser shoes 14 are located symmetrically about the mandrel 11.

Figure 5A:
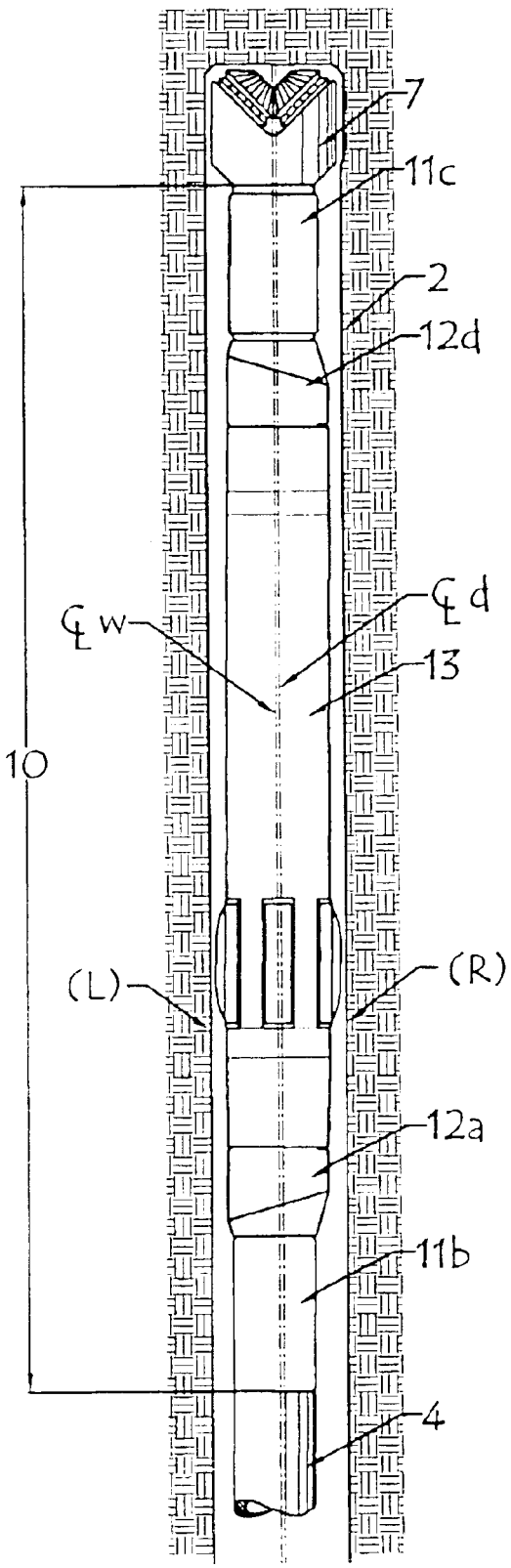
FIG. 5A is an elementary top view of the tool of FIG. 1 employed in a wellbore illustrating its use in making a right-turn.
Figure 5B:
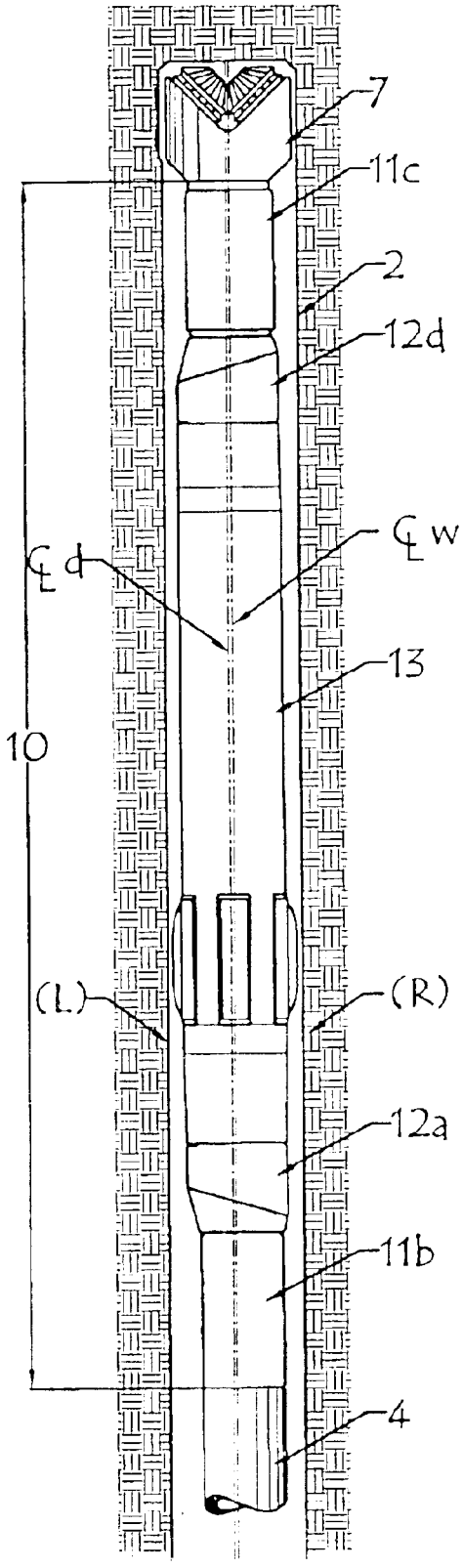
FIG. 5B is an elementary top view of the tool of FIG. 1 employed in a wellbore illustrating its use in correcting right-hand bit-walk or, alternatively, illustrating its use in making a left-hand turn.

The operation of the device will now be described with reference to FIGS. 5A and 5B. FIGS. 5A and 5B show external views of the tool 10 similar to that shown in FIGS. 2 and 3. Therefore, to avoid unnecessary repetition, like reference numerals will be used to denote like features. The description of such features will not be repeated. A drill bit 7 is located on the lower end of the tool 10 in the manner described with reference to FIG. 1. Further, an adapter sub 4 is located to the upper part of the mandrel 11 as also described with reference to FIG. 1.

Both FIGS. 5A and 5B show a "top view" of the device, i.e. the device 10 is viewed from the high side of the wellbore and the pregnant portion 20 is located on the lower side of the wellbore underneath the device 10. In FIG. 5A, the upper and lower sleeve 12 offset is set to the far right of the wellbore. This means that the thicker side of the inner sleeve 12 is located towards the right hand side of the wellbore. This causes the outer housing to exert pressure against the right hand side of the wellbore 2. The fulcrum effect against the right side of the wellbore creates a force against the right hand side of the rotating mandrel which forces the drill bit which is attached thereto to create a hole with a left hand bias.

The inner sleeve 12 has an upper portion 12*a* and a lower portion 12*d*. In this specific example, both portions are moved together. Both portions are drawn with an inclined line which shows the position of the wide side of the inner sleeve 12. This line is a result of the internal cam like form of the inner sleeve. The inner sleeve, of necessity has a wider side and a narrower side.

For the sake of clarification, whenever the radial placement of the wider part of the inner sleeve is in a certain attitude with respect to the borehole, forces generated by the inner sleeve section will deviate the borehole in a vector at 180° degrees relative to the radial position of the wider section.

The widest part of the inner sleeve which is closest to the outer housing 13 (as drawn) defines the position of the bias of the inner sleeve.

FIG. 5B shows the reverse situation to FIG. 5A. Here, the wider bias portion of the inner sleeve is directed towards the left hand wall of the wellbore 2. This causes the outer housing 13 to exert pressure against the left hand side of the wellbore. Thus, in this case, the fulcrum effect against the left side of the wellbore causes the bit to create a hole with a right band bias.

The above operation whereby the wider side of the inner sleeve can be switched either to the right hand side or left hand side of the pregnant portion 20 of the housing is a simplified mode of operation. However, the device of the present invention is capable of far more complex operations. In the preferred embodiment, the position of the sleeve can be controlled to within a tolerance of 10° or less in some cases.

The wider side of the inner sleeve 12 can even be oriented 180° away from the pregnant portion 20. This arrangement places the fulcrum force at two points of the assembly at the bottom of the outer housing and also on the bit itself. This causes the bit to move downwards, but the method of undercutting the outer housing. In a similar manner, the bit could also be driven upwards by aligning the wider part of the inner sleeve along an axis which is parallel with the pregnant housing. This would cause the bit to be driven upwards. Therefore, any combination of up/down/left/right bit directional control could be accomplished.

Figure 6:
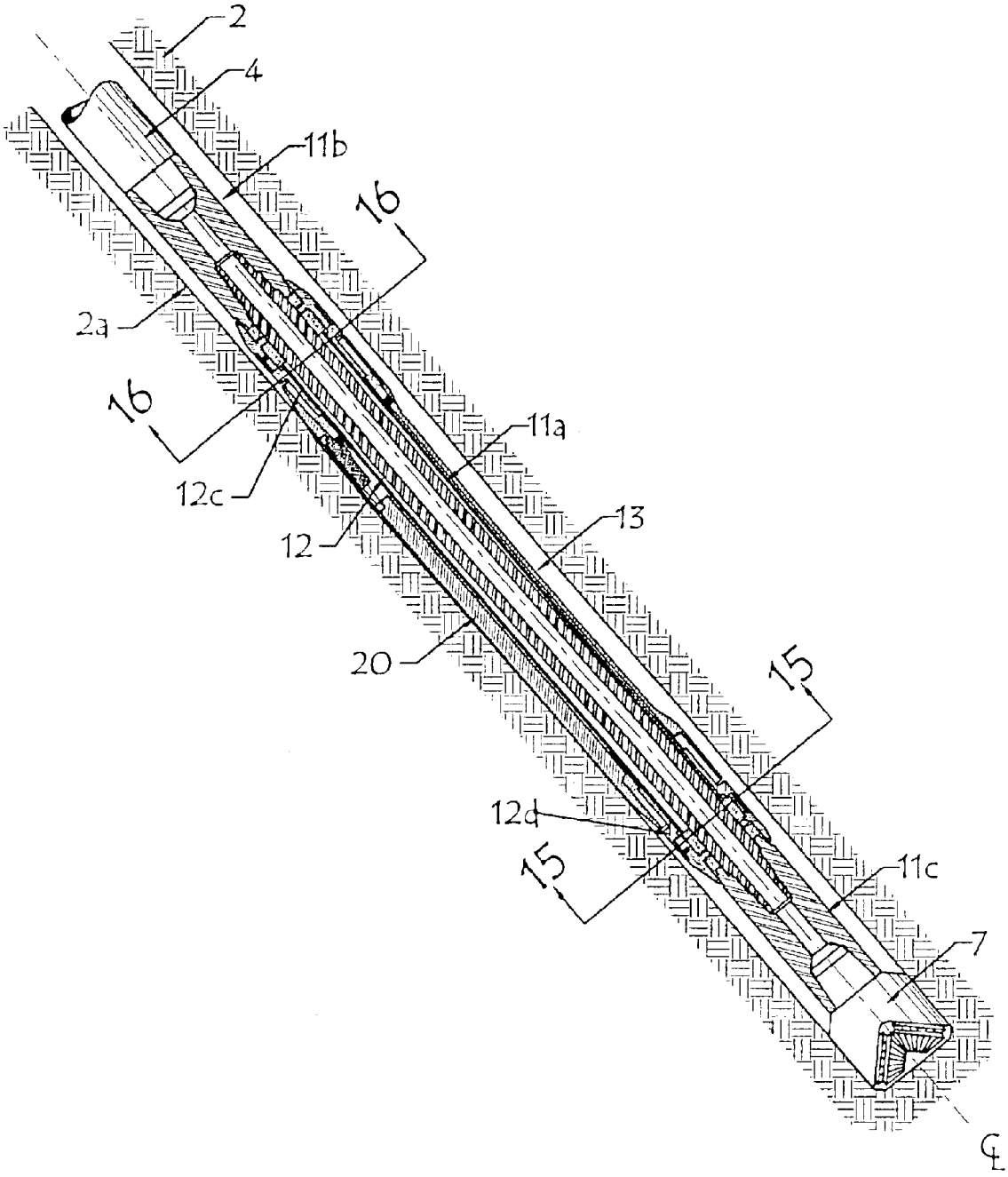
FIG. 6 is a tool according to another embodiment of the present invention utilizing an eccentric sleeve and a concentric sleeve.

FIG. 6 shows a further embodiment of the present invention. To avoid unnecessary repetition, similar reference numerals have been used as for FIG. 1. The construction of the mandrel 11 and the outer housing 13 are identical to those described for FIG. 1. However, the upper part of the inner sleeve differs from that shown in FIG. 1 in that the upper part of the inner sleeve 12*c* is concentrically bored. This combination of a concentric upper sleeve, 12*c*, and an eccentric lower sleeve, 12*d*, allows more control over the drilling direction, and has substantial arrangement with respect to the drilling mechanics. Further, this relatively simple arrangement whereby only movement of the upper sleeve is required is particularly advantageous. This so-called "point-the-bit" arrangement can also be achieved if the lower sleeve is concentric and the upper sleeve is eccentric.

The forces which are created in a "point-the-bit" scenario may differ from those created when two eccentric sleeve portions are provided. (See FIG. 1.) In a configuration comprising an eccentric sleeve portion and a concentric sleeve portion, the net effect is to tilt the bit off the axis and thus give some degree of tilt to the bit cutting structure. Such an arrangement would give considerable advantages when drilling the wellbore and may result in a cleaner profile to the wellbore, a desirable state of affairs particularly when drilling extended reach well profiles.

Figure 17A:
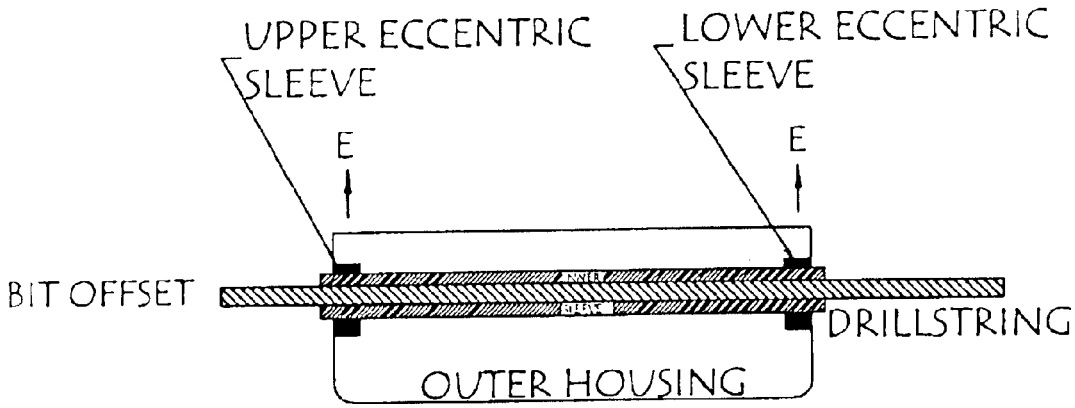
Figure 17B:
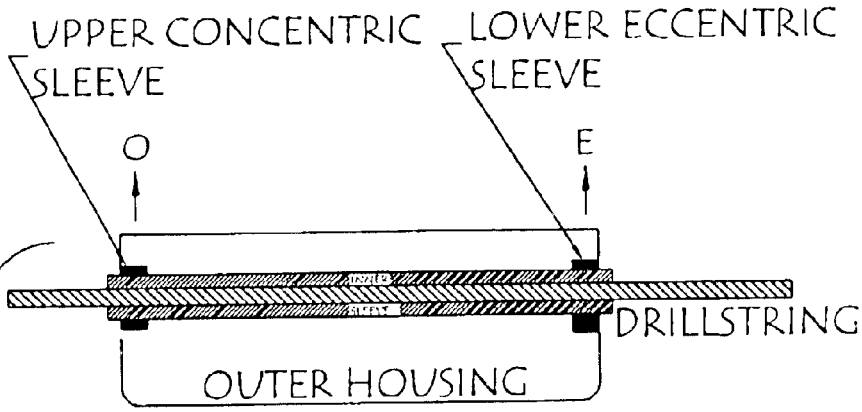
FIGS. 17B and 17C show the device with one concentric sleeve and one eccentric sleeve.
Figure 17C:
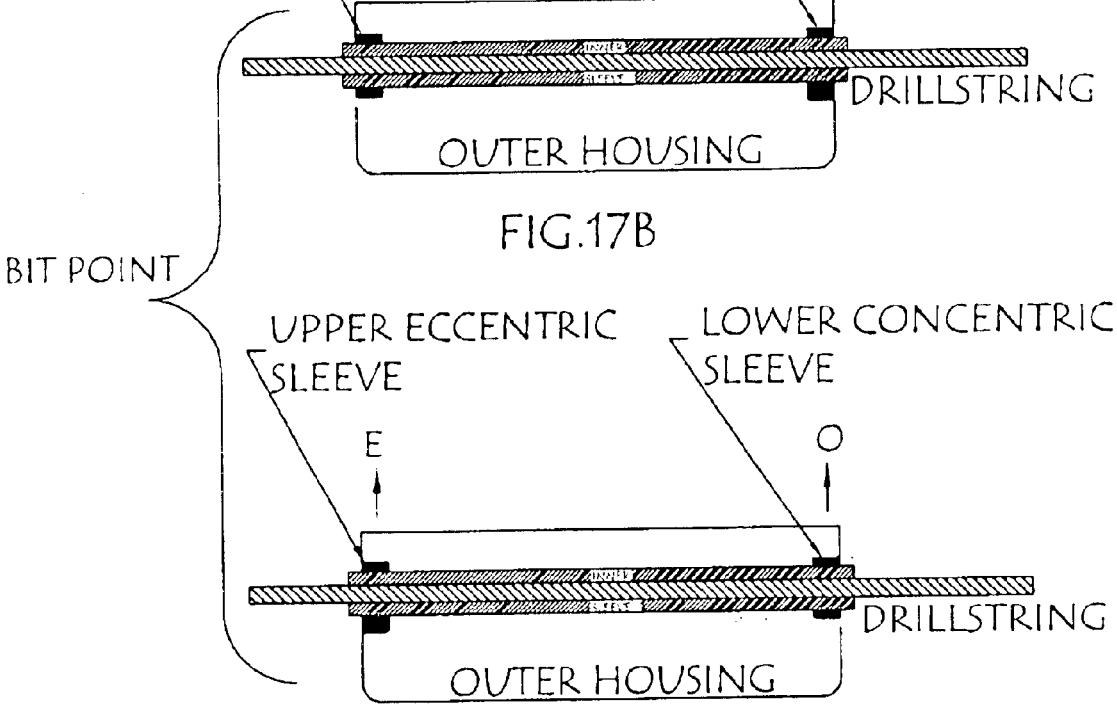
Figure 18A:
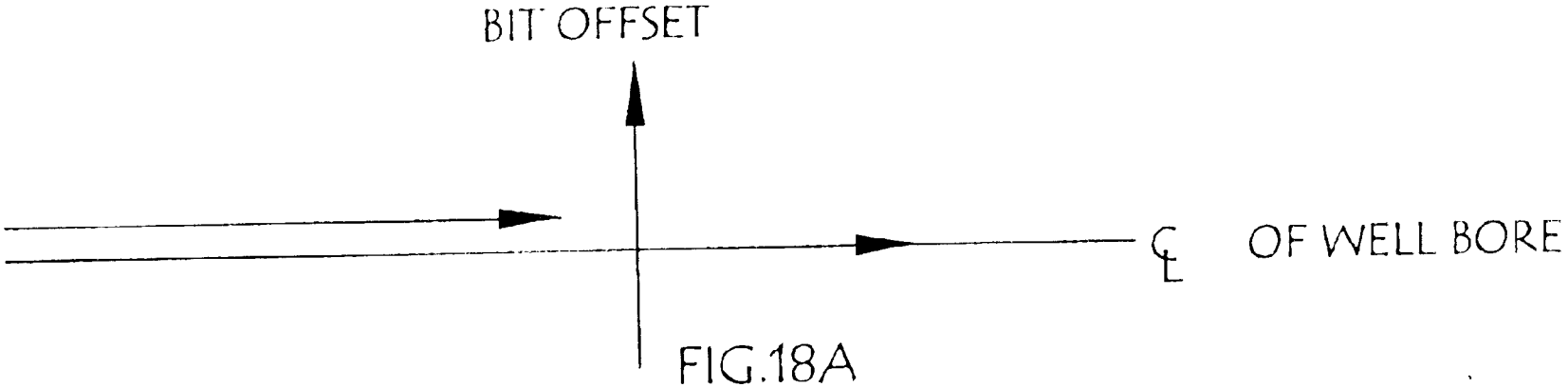
FIG. 18A shows bit offset and FIG. 18B shows bit point.
Figure 18B:
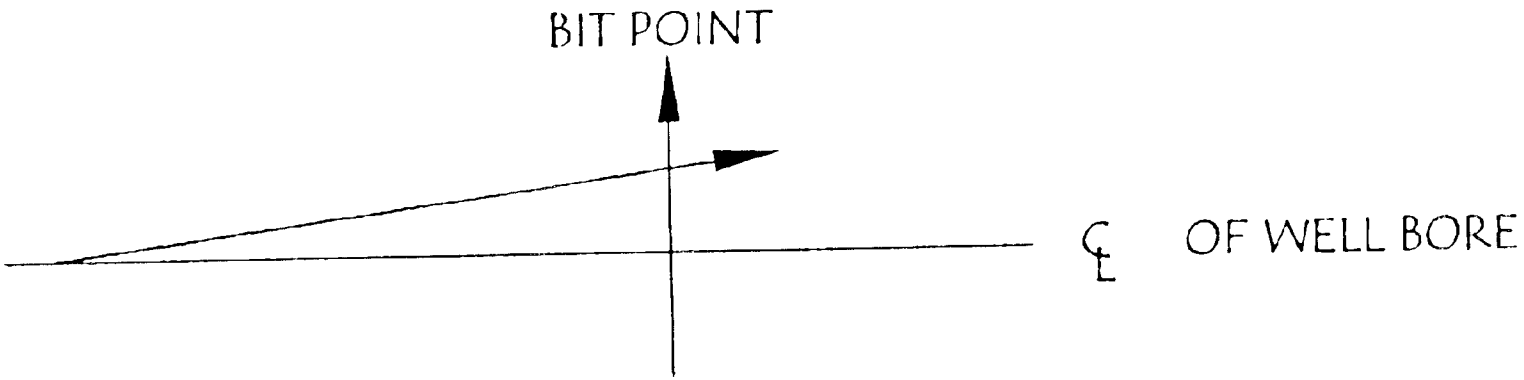

FIGS. 17A and 17C respectively show the conceptual difference between the arrangement of the upper inner sleeve portion, 12*a*, and the lower inner sleeve portion, 12*d*, (both eccentric) shown in FIG. 1 and the arrangement of the upper inner sleeve portion, 12*c*, and the lower inner sleeve portion, 12*d*, shown in FIG. 6 (one concentric-one eccentric). As the previous paragraph implies either one of the inner sleeve portions may be concentric or eccentric. FIG. 18 show how the forces operate within the wellbore. Two eccentric sleeve offset the bit (FIG. 18A); whereas, one eccentric sleeve and one concentric sleeve point the bit (FIG. 18B).

The pregnant portion 20 of the outer housing 13 provides the reference point or "earthing point" against which the bit bias is referenced. The actual bias forces are applied to the appropriate side of the wellbore through one of the stabiliser shoes 21. In use, the mandrel of the tool would be rotating. It is important that rotation of the mandrel 11 does not cause the outer housing 13 to rotate. Therefore, it is important that the rotational torque transferred to the outer housing from the rotating mandrel 11 does not exceed the self-righting torque mass of the outer housing 13 due to gravity. If the outer housing 13 turns away from the reference on the low side of the hole, the bit bias will not be correct and the directional qualities of the device will fail. Therefore, it may be necessary to use different speeds for rotating of the mandrel 11 in order to overcome the mass torque limitations of the outer housing 13.

Paradoxically, the mass of the housing 13 becomes more effective as the angle of inclination (wellbore deviation from vertical) increases. Therefore, higher rotational speeds may be used in this situation. Fortunately, this ability to use higher speeds at larger angles of inclination is coincidental with the requirement for rapid tool response in high angle "near horizontal or horizontal" wellbore. The operator will have to monitor the downhole performance of the tool to determine if the tool is turning away from the low side reference point. Standard well survey devices can provide this information. Adjustments in rotational speed of the mandrel can be varied at the surface to compensate for any shortfall in the mass-torque capacity of the outer housing. As previously discussed, in addition to the operator wishing to drill in a specific direction, there is also a variable force which attempts to drive the bit away from the desired trajectory.

The prior art of deviation correction required a turn in the direction of the wellbore in order to correct for drift left/right (azimuth) or up/down (inclination) form the required wellbore path. Essentially, a bent sub and downhole motor (or steerable motor) would be placed in the wellbore and orientated in the required direction to correct for the calculated directional drift. These tools would place a dogleg (a relatively sharp turn in the wellbore when come to the overall wellbore) at the point of correction. Once the wellbore was established in the correct direction, standard drilling techniques resume until the next survey shows unacceptable drift. Thus, a wellbore is not straight or smooth—it looks like a corkcrew. The instant device will allow for relatively smooth correction; thus, the wellbore will not look like a corkscrew and will be easier to enter and exit during all drilling, casing and production operations. That is, the "quality" of the wellbore will be significantly improved over the present sa of the art.

It should be noted that the inner sleeve can be manufactured with varying degrees of eccentricity or offset from the wellbore center-axis. The required eccentricity would depend on the formation, the diameter of the wellbore, speed of drilling, type of drilling, maximum projected course alternation of the wellbore and the like. The vector interaction of the shoe with the wellbore wall is selectively controlled by the rotation of the inner sleeve; thus, the magnitude of the offset force is dictated by the ratio of the inner sleeve's eccentricity. A smaller ratio being equal to a smaller vector force and a larger ratio being equal to a larger vector force. The offset can vary from tenths of an inch [millimeters] up to inches [centimeters], and ideally, should be field replaceable and adjustable. The larger the offset, the sharper the change in wellbore direction and the higher the load on the internal bearings. In drilling a straight wellbore the eccentricity offset should be less than about ½-inch [1.27 cm].

It should also be remembered that the inner eccentric offset and the effective gauge of the tool (effective gauge being defined as the tool diameter between the outer surfaces of the shoes, or the housing touch point and the internal diameter of the wellbore) are interrelated. Thus, it is important that the effective gauge of the tool be readily adjustable in the field to fit the wellbore gauge (same as the tool's effective gauge) or to account for some unexpected interaction with the tool. For example, the formation may be known to drive the tool further to the right than required; thus, the right shoe could be increased in thickness while the left shoe could be decreased in thickness in order to compensate for this trend. The overall effective gauge of the tool would remain the same, but the side wellbore force on the right of the wellbore would be effectively increased. The actual values and the like would have to be field determined, as are many parameters in the drilling industry. Thus, the shoes are field replaceable and are held in place by pins or any similar effective retaining mechanism.

The choice of inner sleeve and consequential offset, and the tool's effective gauge, may be made at the rig site. The drilling engineers would look at formation characteristics, the drilling program and other well known parameters to determine an initial offset and gauge. If the tool was over- or under-correcting, then the inner sleeve (or shoes) would be changed at a suitable opportunity (such as a "bit trip") and the tool returned to the wellbore.

Figure 7A:
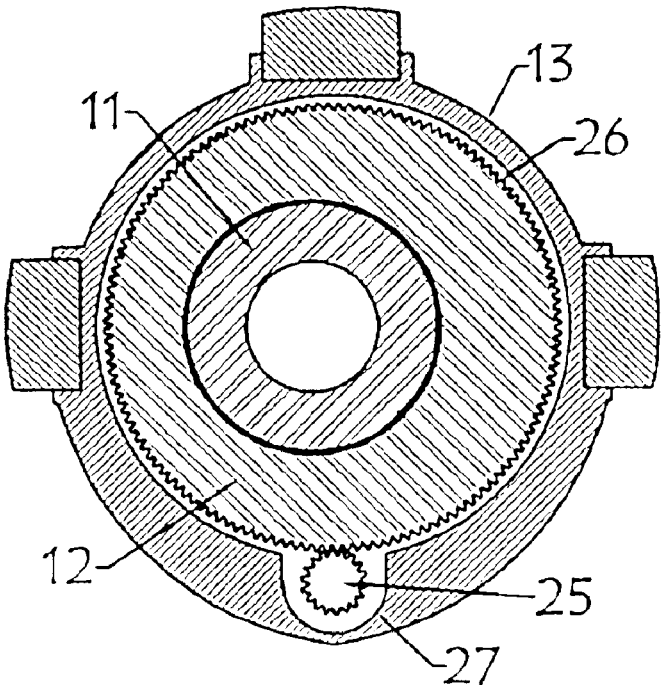
FIG. 7A illustrates a drive coupled to the inner mandrel powered by a motor means.
Figure 7B:
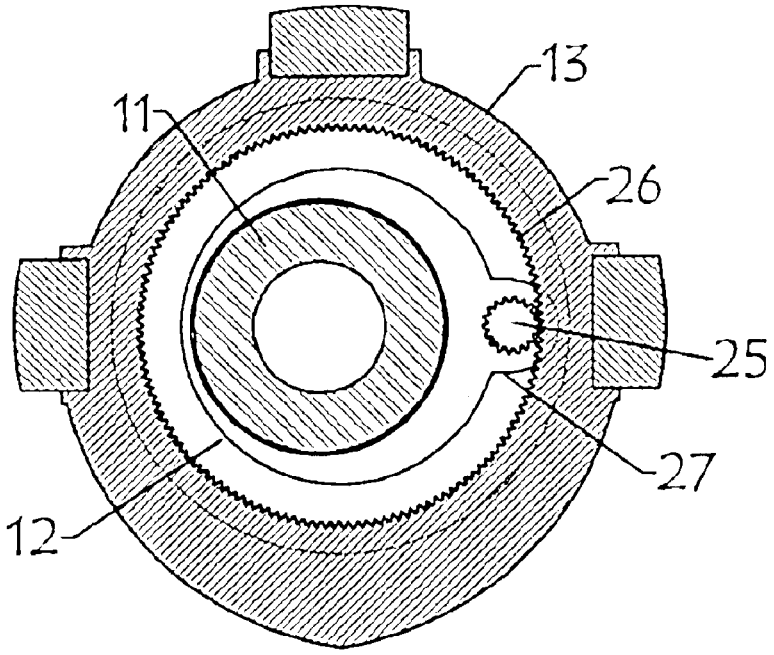
FIG. 7B illustrates a drive coupled to the outer housing powered by a motor means.

Previously, the specification has referred to drive means for positioning the inner sleeve 12 with respect to the housing 13. FIGS. 7A and 7B show potential arrangements for positioning the inner sleeve 12 with respect to the outer housing.

In FIG. 7A, the driver is located within the pregnant portion of the housing 20. A cavity 27 is located within the pregnant portion 20. Within this cavity is located a drive gear 25. The outer circumference of the inner sleeve 12 is provided with a pinion gear. The teeth on pinion gear 25 are capable of inter-engaging with the teeth on rack 26 such that movement of the pinion 25 effects movement of the sleeve 12 with respect to the outer housing 13. Further, typically, the means for driving pinion 25 which may comprise an electric, hydraulic motor or other means, will be located within the pregnant portion 20 of housing 13. The power supply may be provided by a battery which is also located within the pregnant housing or, the rotation of the mandrel 11 may be used to rotate the pinion 25.

FIG. 7B shows a variation on the arrangement of FIG. 7A. Here, a rack is provided around the inner circumference of the outer housing 13. The weighted side of inner sleeve 12 is provided with pinion 25. Movement of the pinion 25 effects movement of the outer housing 13 in a similar manner to that which was described with reference to FIG. 7A.

As the teeth of the rack 26 and the pinion 25 interact, the inner sleeve 12 and outer housing are locked in position with respect to one another once pinion 25 becomes stationary.

In order to change direction of the tool or the correct for bit walk, the drive means must be actuated and told by how much to move the inner sleeve. Such information could be signaled from the surface. Further, it is preferable if there is some method of signaling the surface to confirm the position of the inner sleeve 12.

It is be possible to use survey tools and track the wellbore direction and, whenever the direction is not correct, the device 10 may be signaled from the surface to make the required alteration. For example, to rotate the bearing part of the inner sleeve from left to right or vice versa, or from up to down or vice versa to any degree of rotation of the inner sleeve 12 or parts of sleeve with respect to the outer housing, at surface and then communicated to the downhole device in order to effect a required rotation of the inner sleeve.

The degree of rotation of the inner sleeve during setting the device is contingent upon the initial position of the sleeve, and the required resultant direction of the wellbore.

Figure 8:
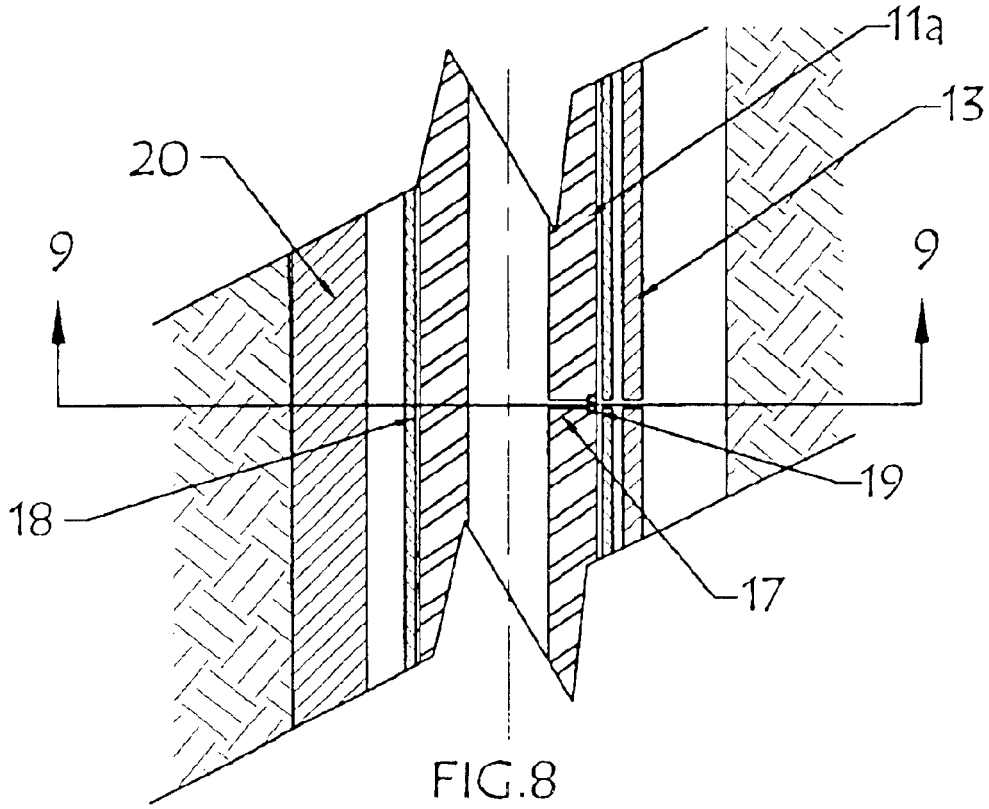
FIG. 8 is an elementary cross section illustrating the fluid pressure inner eccentric sleeve position signaling means.
Figure 9:
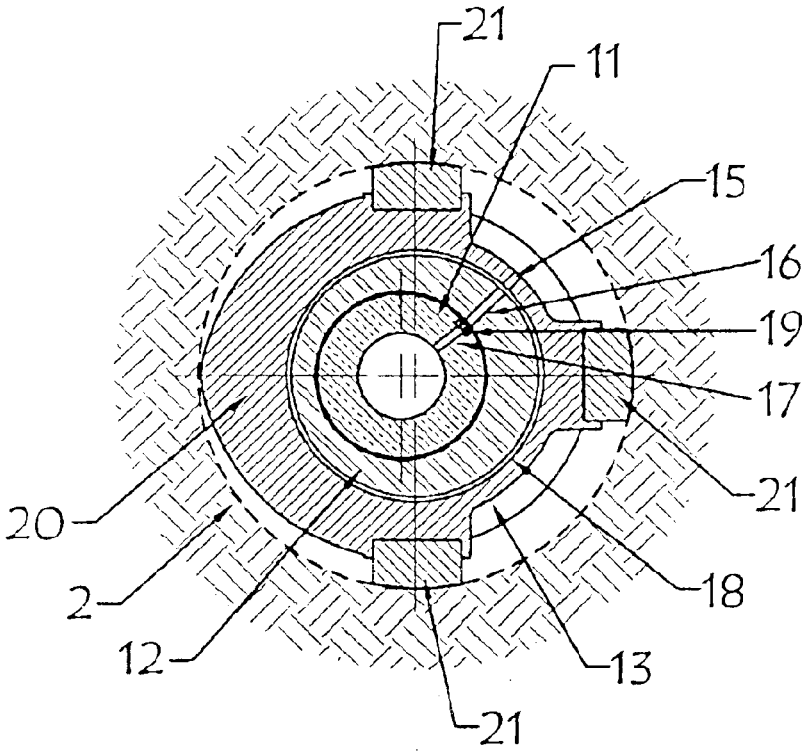
FIG. 9 is an elementary cross section of the device, showing the fluid pressure signaling means, taken at 9-9 in FIG. 8.

The preferred technique will be described for the motion of a single part of the inner sleeve which is illustrated in FIGS. 8 and 9. A passageway, 17, is bored in the rotating mandrel which allows some drilling fluid to exit the bore via additional offset passages bored in the inner sleeve, 16, and in the outer housing, 15. The passageway, 17, in the rotatable mandrel terminates in bit-jet/orifice, 19, combination. The bit-jet is capable of taking the pressure drop without damage. A groove, 18, is cut in the outer surface of the inner sleeve 12 which allows the drilling fluid to exit the bore even if the passages, 15,16, are not aligned. When the passages, 15,16, are aligned, the rate of drilling fluid leaving the bore is higher than the rate when the passages are not aligned. Thus, a pressure difference signal would occur at the surface whenever the inner sleeve is toggled or switched from one position to another.

In the right-most position more fluid leaves the bore. In the left-most position, less fluid leaves the bore. A pressure change will occur at the ground surface because more or less fluid is bypassing the bit. Pressure changes are easily measured in the industry. If the pressure changes from high to low, then the eccentric is in the right-most position. If the pressure changes from low to high, then the eccentric is in the left-most position. The construction of labyrinthine passageways based on the principle detail above may enhance the ability of the tool and allow multiple sleeve positions to be indicated at the surface.

Other techniques could be used to signal the state of the inner sleeve and such techniques are not outside the scope of this disclosure. For example, an encoding using a series of coded pulses could be used. Such pulses would be sent to the surface during motion of the inner sleeve which may be decoded, using standard industry techniques, to disclose the resting position of the sleeve 12. It may be possible to pass an electrical, or acoustic, or some other signal to a secondary tool or to instrumentation within the bottom hole assembly and have that tool pass the required information to the surface. The passage of coded information to the surface as a series of mud pulses or other telemetry devices is well accepted and used in the industry.

In a similar manner, the passing of pressure pulses from the surface to the tool may be used to signal the logic to toggle the state of the inner sleeve 12. For example, the simplest and preferred toggling technique is to stop drilling for a period of time which exceeds the time period to add a joint of drill pipe. During this period of time, the mud pressure would drop and the logic "sees" the event. The logic starts a timer and after the proper period of time the inner sleeve is told to toggle its state. Depending on the motor means the sleeve would toggle or wait until fluid flow resumed in order to capture a driving force. This technique may be expanded to signal a stepper motor drive means to move to a given position, or to individually signal a BHA incorporating both up/down and left/right tools. Thus, any of the standard mud signaling techniques could be used.

The logic used in connection with the tool of the invention an be an integral part of the tool or located completely separate therefrom. Furthermore, an energy source or power pack for supplying the logic circuits can be located within the tool, as an attachment located in a separate sub, or completely remote therefrom.

Communication between the surface and the instant device may also be established through use of the rotation of the drill string. The logic means can include means for detecting drill string rotation wherein said drill string rotation contains encoded information which is understood and decoded by downhole mechanisms or instrumentation which determine the radial position of said inner sleeve of the apparatus.

Also, the logic means may include means for detecting drill string rotation and measuring a time period between rotation and non-rotation of the drill string. The measured time period can be used to determine when said inner eccentric sleeve should be rotated with respect to said outer housing. Thus, the apparatus may include a timing device.

In addition, the logic means may include a method and apparatus for enabling the instant device to detect the rotation of the drill string and quantify the rotational speed of the drill string in such a manner as to be able to accurately quantify the rotational speed in order to determine a numerical value which may be used in determining sleeve position.

Figure 10:
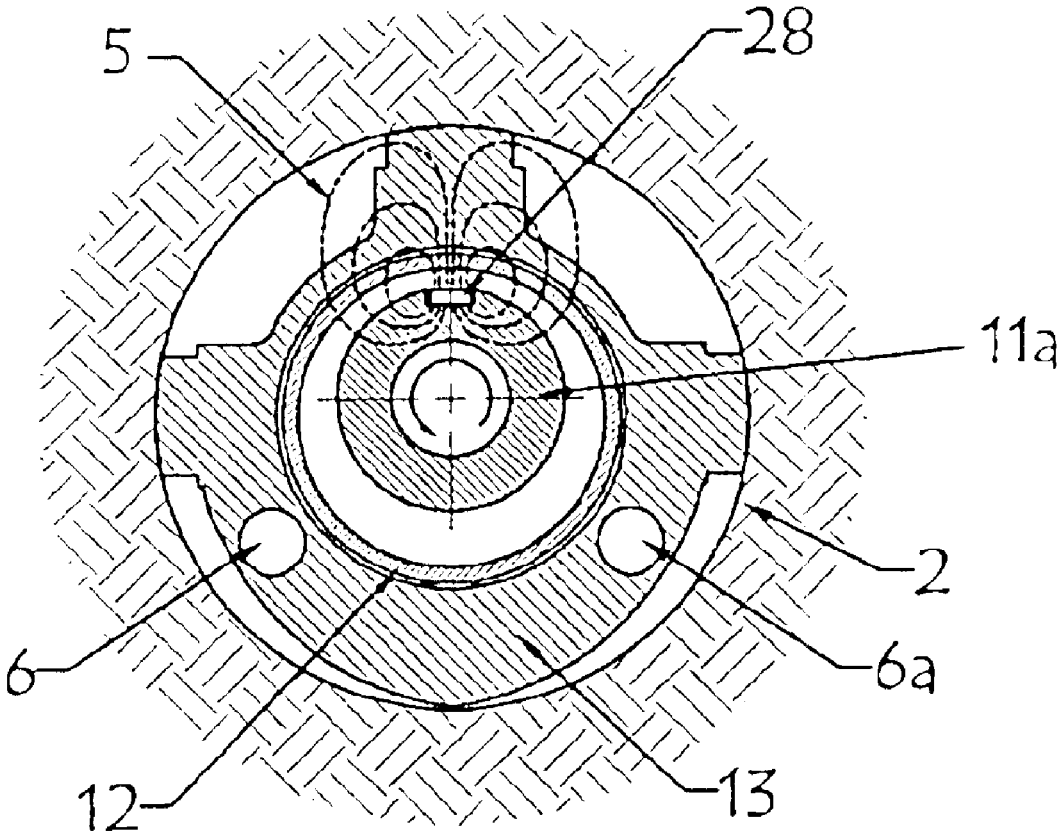
FIG. 10 is an elementary cross section of the device illustrating a signaling means using magnetic fields.

Such an arrangement is shown in FIG. 10. The device 10 comprises a outer housing 13 with an eccentric bore. An inner sleeve 12 is located within said bore such that the outer housing 13 is rotatably coupled about said inner sleeve 12. The inner sleeve 12 also has an eccentric bore which is configured to accommodate a rotating mandrel 11 such that said inner sleeve 12 can rotate relative to both said outer housing 13 and said mandrel 11.

A communications device comprising a magnet 28 is attached to said rotating member 11. The magnet is located in a pocket on said rotating member 11. This specific embodiment uses the magnet as an emitter. However, it will be appreciated by those skilled in the art that the magnet could be replaced by any type of emitting sensor.

The outer housing 13 contains instrument barrels 6. The instrument barrels 6 are provided with sensing means. During drilling of the well bore 2, the heavy portion of the outer housing seeks the low side of the well bore and the position of the outer housing remains relatively fixed with respect to the well bore. The mandrel 11 and magnet 4 rotate relative to the outer housing 13. Lines of flux 5 radiate from the magnet 4 with sufficient magnitude to overcome the Earth's ambient field. The flux lines 5 extend radially beyond the instrument barrel 6 such that sensors within the instrument barrel 6 can detect the intensity of the emitted magnetic field.

When the magnet 28 is rotated such that it is closest to the sensors in the instrument barrel 6, the sensors detect a maximum amplitude in the magnetic field. In a similar manner, when the magnet 28 is furthest from the instrument barrel 6, a minimum in the amplitude of the magnetic field will be detected. The field detected by the sensors may be sinusoidal if it is possible to sense the radiated magnetic field at all times when the mandrel 11 is rotating. In order to accomplish this, at least a part and possibly the entire drill string mandrel will have to be constructed from austenic type materials, or materials with similar non-magnetic properties.

However, as it is only necessary to measure the frequency of rotation of the mandrel 11, it is adequate if the sensor is just configured to detect a maxima in the field when the magnet is at its closest to the sensor. In other words, the sensor just needs to detect a series of pulses where each pulse is equivalent to one each rotation of the mandrel 11.

Thresholds may also be set which negate the effect of the Earth's magnetic field and which serve as limit switches. These limit switches may be employed as a means of logic control within the sensor array or within a logic control sub assembly.

A second instrument barrel **6*a*** is also shown. This may contain magnetic sensors. The provisions of two magnetic sensors allows errors to be more easily detected.

The sensor which isolated within the instrument barrel is preferably situated in a stainless steel, or another magnetically transparent pressure vessel such that the instrumentation is isolated from the borehole pressure. The instrumentation barrel may comprises a magnetometer, or Hall effect device or the like for detecting the magnetic field.

Inevitably, there will be material between the magnetic sensor in the instrument barrel 6 and the magnet 28 located on the rotating member. This intervening material should, as far as possible, be magnetically transparent. In other words, the magnetic field should pass through this material without becoming deflected or distorted. Materials which exhibit these properties include austenic stainless steels and other non-ferrous material.

Figure 11:
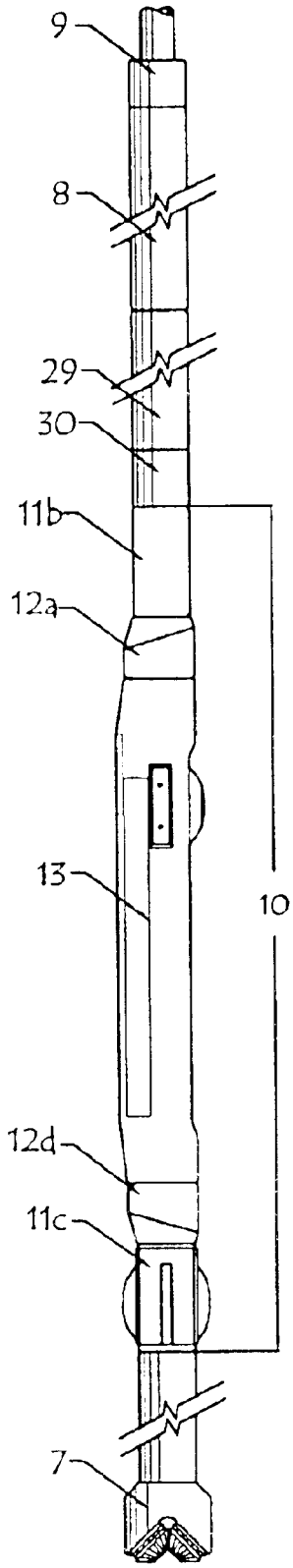
FIG. 11 is a Bottom Hole Assembly, including a tool according to the invention, bit, MWD tool, drill collars, etc. used for left/right borehole correction only.

FIG. 11 shows an embodiment of the present invention. As in FIG. 1, the downhole tool is connected to a drill bit and an adapter sub 30. In FIG. 11, the lower part of the mandrel 11 is connected to the drill bit 7 by adapter sub 3.

The upper adapter sub 30 allows the tool 10 to be connected to surveying tools 29 and drill collars 8. The drill collars are attached to drill string 9. Additional stabilisers (not shown) will be added as per standard drilling procedures.

Figure 12A:
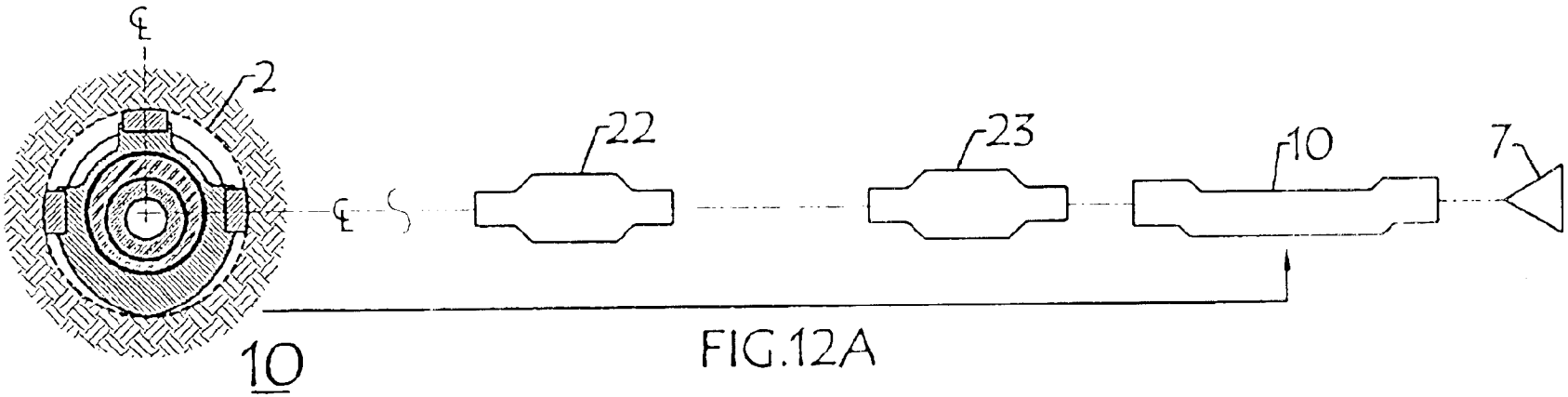
FIG. 12A is the diagrammatic illustration for the suggested Bottom Hole Assembly of FIG. 11 showing the device, bit and stabilizers used for left/right borehole correction only.
Figure 12B:
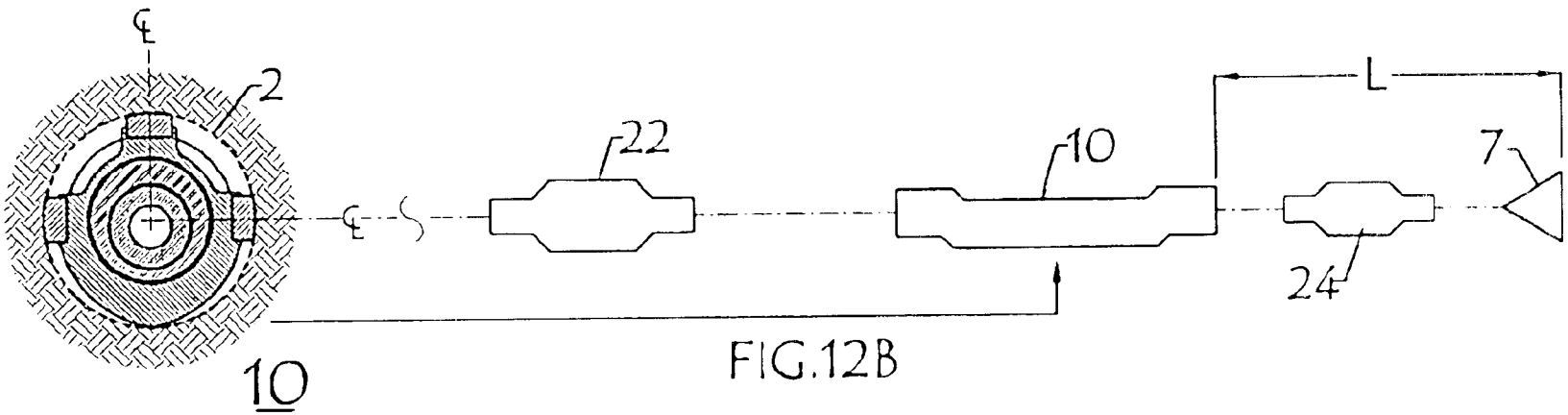
FIG. 12B is a suggested diagrammatic Bottom Hole Assembly, including the device, bit and stabilizers used for up/down borehole correction only.

FIGS. 12A to 12B show a diagrammatic illustration of an arrangement of stabilisers used in a drilling operation without showing the required collars, survey tools and subs.

FIG. 12A is a diagrammatic illustration of an arrangement of s used in a drilling operation without showing required collars, survey tools and subs. The instant device, 10, is followed by a second string stabilizer, 23, and any additional stabilizers 22. that the during program may require.

As previously explained, the tool can provide directional control both up and down and left to right. For up/down control the offset provided by at least one of the parts of the direction control means is provided either next to the weighted side of the housing or opposite the position of the weighted side of the housing. FIG. 12B is a diagrammatic representation of a device used to control up/down only. Here the bit, 7, is followed by a near bit stabilizer, 24, with the up/down tool 10, placed at distance "l" from the bit. This distance would range between 15 feet [4.57 m] and 30 feet [9.14 m]. (the use of the British System of units is the standard of the drilling industry; hence, this description uses the industry standard.)

The above description has largely concentrated on a device where the direction control means are provided by eccentric sleeves or cams. However, the present invention can also be realized by using linear actuators as part of the direction control means. Such linear actuators can be provided so as to bias said mandrel in the same manner as the aforementioned sleeves or cams.

Figure 13:
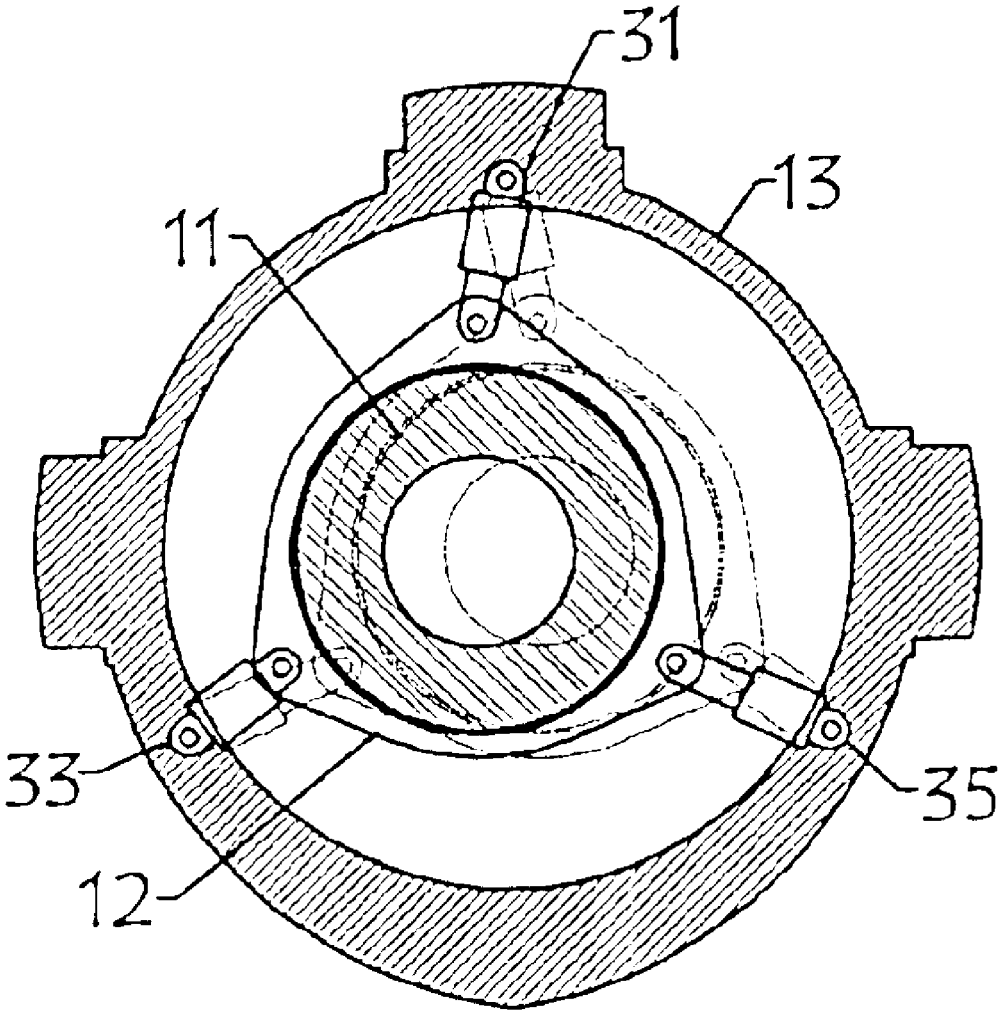
FIG. 13 is an elementary cross section of a device in accordance with a preferred embodiment where the direction controller comprises a plurality of linear actuators.

FIG. 13 shows a cross-section of the apparatus configured with linear actuators.

To avoid unnecessary repetition, where appropriate, like reference numerals will be used to denote like features. Comparing FIG. 13 with the cross-sections of FIGS. 7A and 7B, it can be seen that a weighted housing 13 is provided which surrounds mandrel 11*a*. Mandrel 11*a* is located within sleeve 12. Mandrel 11*a* is free to move within sleeve 12. Sleeve 12 is connected to housing 13 via three linear actuators, 31, 33 and 35. The three linear actuators 31, 33 and 35 are disposed in a plane about said mandrel and are offset from one another by 120°. Each of the linear actuators is configured such that it can extend or contract as required.

In FIG. 13, linear actuator 35 is filly extended, linear actuator 33 is fully contracted and linear actuator 31 is partially extended. In this arrangement, the mandrel is biased towards the top left of the figure in the same manner as the mandrel of FIG. 7A. The dotted lines indicate a different position where linear actuator 35 is contracted and actuator 33 is extended to bias the mandrel position over towards the right band side of the housing 13.

Thus, the linear actuators can be used to bias the mandrel with respect to the weighted housing 13 as required in order to change the direction of drilling.

Figure 14:
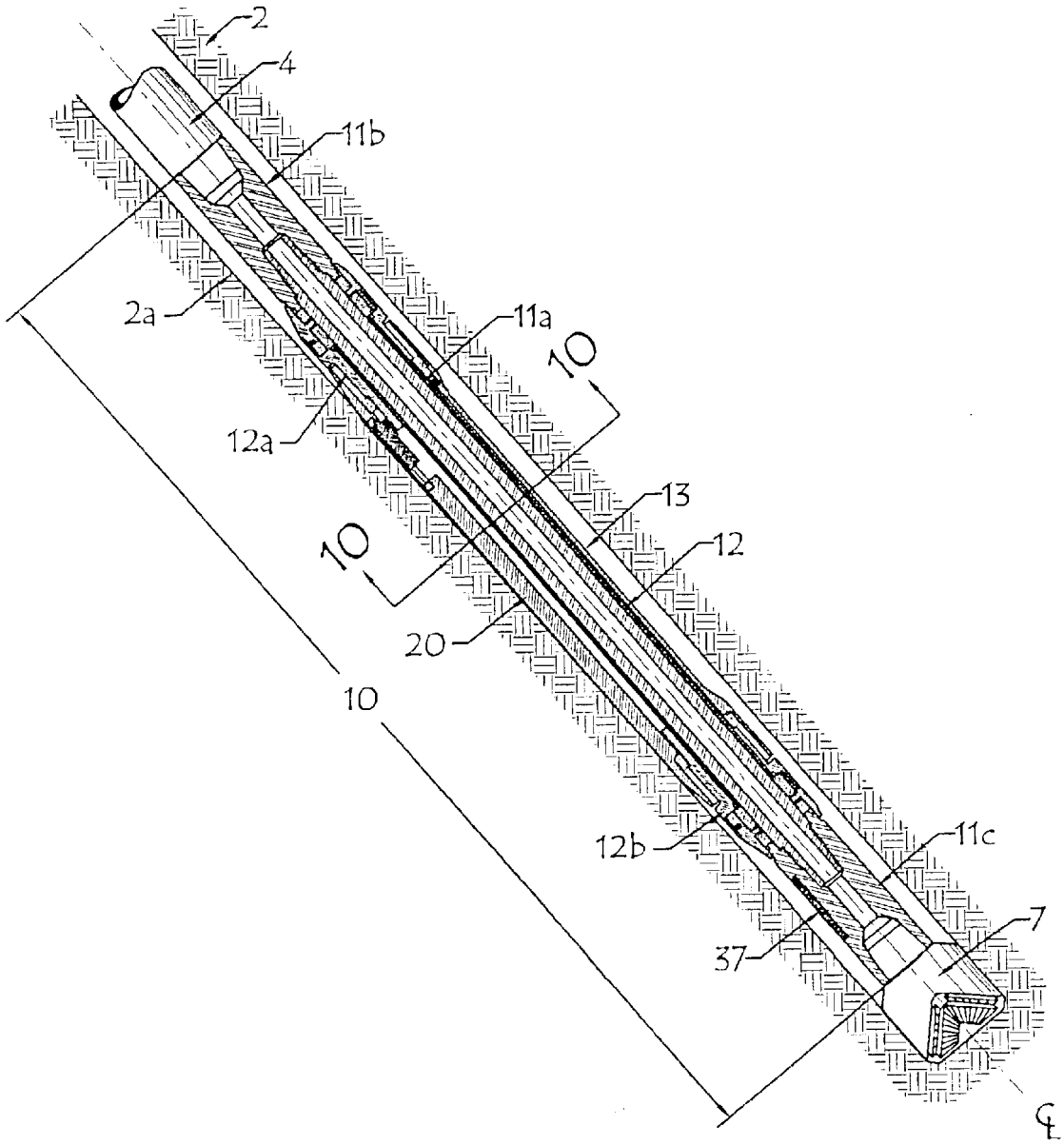
FIG. 14 is a schematics of a device according to a preferred embodiment of the invention and containing a sensor.
Figure 15:
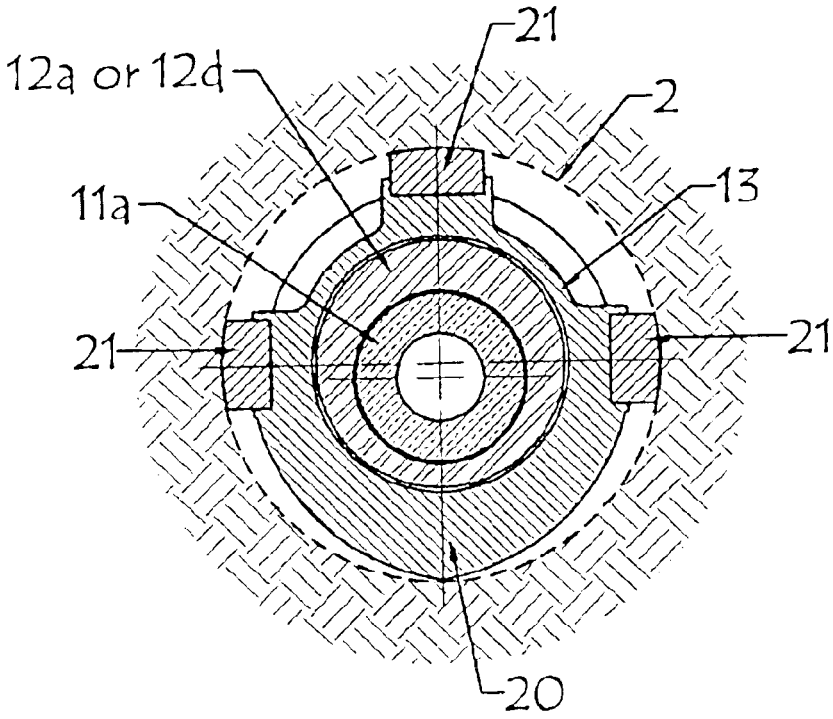
FIG. 15 is a schematic of the tool of FIGS. 1 and 6 taken at 15A-15A in FIGS. 1 and 6.
Figure 16:
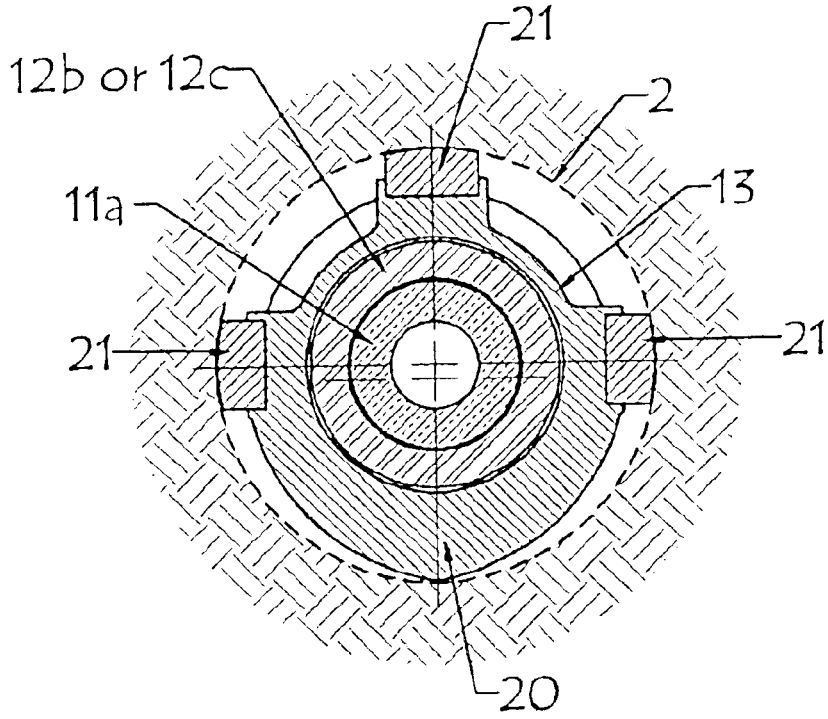
FIG. 16 is an elementary cross section of the tool of FIG. 6 taken at 16A-16A on FIG. 6.

FIG. 14 is a schematic illustrating a preferred embodiment of a device in accordance with the invention where the device further comprises a sensor, 37.

To avoid unnecessary repetition, the same reference numerals will be used as those of FIG. 1. In addition a sensor 37 is located on lower mandrel 11*c*. The sensor may be located at other positions on the device.

The sensor may be a gamma ray sensor and may be configured to send information to the surface such that the tool may be controlled from the surface or may be configured to analyse the signals which it collects such tat the device can use this information to select its own preferred drilling direction.

What is claimed is:

1. An apparatus for selectively controlling the direction of a well bore comprising:

a mandrel rotatable about a rotation axis;

a direction controller comprising three parts configured to apply a force to the mandrel having a component perpendicular to the rotation axis and having a component parallel to the rotation axis wherein the mandrel freely rotates within the direction controller and wherein said three parts comprise a first sleeve with an eccentric bore, a second sleeve with a concentric bore and a third sleeve extending between the sleeves;

a housing having an eccentric longitudinal bore forming a weighted side and being configured to freely rotate under gravity about the rotation axis wherein the housing contains the direction controller; and a driver for selectively varying the angle of the force relative to the weighted side of the housing about the rotation axis wherein the driver is configured to move the direction controller independently of the housing.

2. The apparatus of claim 1, wherein the driver is configured to move the sleeves independently of one another.

3. The apparatus of claim 1, wherein the driver is configured to change the direction within a tolerance between 5° and 1°.

4. The apparatus of claim 1, wherein said driver comprises a drive wheel and a track, said drive wheel being engagable with said track such that movement of said drive wheel causes movement of said track relative to said drive wheel and said drive wheel when stationary prevents movement between said track and drive wheel, the drive wheel and track being located such that movement of the drive wheel effects relative movement between the force and the weighted side of the housing.

5. The apparatus of claim 4, wherein said track is located on a surface of said housing and said drive wheel is mechanically connected to said direction controller.

6. The apparatus of claim 4, wherein the said track is located on an inner surface of said housing.

7. An apparatus for selectively controlling the direction of a well bore comprising:

a mandrel rotatable about a rotation axis;

a direction controller comprising three parts configured to apply a force to the mandrel having a component perpendicular to the rotation axis and having a component parallel to the rotation axis wherein the mandrel freely rotates within the direction controller and wherein said three parts comprise a first sleeve with an eccentric bore, a second sleeve with a eccentric bore and a third sleeve extending between the sleeves;

a housing having an eccentric longitudinal bore forming a weighted side and being configured to freely rotate under gravity about the rotation axis wherein the housing contains the direction controller; and a driver for selectively varying the angle of the force relative to the weighted side of the housings about the rotation axis wherein the driver is configured to move the direction controller independently of the housing.

8. The apparatus of claim 7, wherein the driver means is configured to move the sleeves independently of one another.

9. The apparatus of claim 7, wherein the driver is configured to change the direction within a tolerance between 5° and 1°.

10. The apparatus of claim 7, wherein said driver comprises a drive wheel and a track, said drive wheel being engagable with said track such that movement of said drive wheel causes movement of said track relative to said drive wheel and said drive wheel when stationary prevents movement between said track and drive wheel, the drive wheel and track being located such that movement of the drive wheel effects relative movement between the force and the weighted side of the housing.

11. The apparatus of claim 10, wherein said track is located on a surface of said housing and said drive wheel is mechanically connected to said direction controller.

12. The apparatus of claim 10, wherein said track is located on an inner surface of said housing.

* * * * *